US009012757B2

(12) United States Patent
Hirshberg

(10) Patent No.: US 9,012,757 B2
(45) Date of Patent: Apr. 21, 2015

(54) SYNTHESIZED SIGNAL TUNER

(71) Applicant: David Hirshberg, Haifa (IL)

(72) Inventor: David Hirshberg, Haifa (IL)

( * ) Notice: Subject to any disclaimer, the term of this patent is extended or adjusted under 35 U.S.C. 154(b) by 0 days.

(21) Appl. No.: 14/010,541

(22) Filed: Aug. 27, 2013

(65) Prior Publication Data

US 2014/0060289 A1 Mar. 6, 2014

Related U.S. Application Data

(63) Continuation-in-part of application No. 13/591,250, filed on Aug. 22, 2012, now Pat. No. 8,546,675.

(51) Int. Cl.

| | |
|---|---|
| ***G10H 5/00*** | (2006.01) |
| ***G10G 7/02*** | (2006.01) |
| ***G10H 5/02*** | (2006.01) |
| ***G10H 1/44*** | (2006.01) |
| ***G10H 3/18*** | (2006.01) |

(52) U.S. Cl.

CPC .. *G10G 7/02* (2013.01); *G10H 5/02* (2013.01); *G10H 5/00* (2013.01); *G10H 1/44* (2013.01); *G10H 3/188* (2013.01); *G10H 2250/235* (2013.01)

(58) Field of Classification Search

USPC ..... 84/616, 654, 312 R, 454, 455

See application file for complete search history.

(56) References Cited

U.S. PATENT DOCUMENTS

| | | | | |
|---|---|---|---|---|
| 5,343,793 | A * | 9/1994 | Pattie | 84/454 |
| 5,977,467 | A * | 11/1999 | Freeland et al. | 84/454 |
| 6,525,255 | B1 * | 2/2003 | Funaki | 84/616 |
| 6,995,311 | B2 * | 2/2006 | Stevenson | 84/737 |
| 7,547,838 | B2 * | 6/2009 | Okuyama et al. | 84/454 |

* cited by examiner

*Primary Examiner* — Jeffrey Donels

(57) ABSTRACT

A musical instrument comprising: (a) plurality of identical vibrating elements; (b) a digitizer associated with each said vibrating element; (c) an estimator that measures the fundamental vibration frequency of said vibrating element; and (d) a synthesized tuner, that conditioned upon at least said estimated fundamental frequency of each vibrating element, generate an audio signal that comprises the characteristics of the original vibration signals with a different fundamental frequency for each said original vibration signal.

18 Claims, 13 Drawing Sheets

SYNTHESIZED SIGNAL TUNER

CROSS REFERENCE TO RELATED APPLICATION

This application is a continuation-in-part of application U.S. Ser. No. 13/591,250, filed on Aug. 22, 2012, which is hereby incorporated by reference in its entirety.

FIELD AND BACKGROUND OF THE INVENTION

The present invention, in some embodiments thereof, relates to musical instruments and, more particularly, but not exclusively, to a string based musical instruments.

String musical instruments are very popular. Guitar, Piano, Harp, Sitar and Violin are all string instruments. The basic physical formulation of the vibration frequency is a function of the length of the string, the materials of the string and the tension of the string. Those parameters impose a major constrain in the design of a string based musical instrument. Furthermore, the fact that the vibration frequency is in opposite linear relation with length dictates the length of the device and the fret board spacing in devices where the string tune is adjusted by changing the length of the vibrating portion of the strings, for example, in guitars and violin.

One known problem of string musical instrument is the need for constant tuning to mach the instrument to musical note standard and to match the frequency relationship between different strings. This is usually done manually by the musician by rotating a screw that changes the tension of the strings.

In the middle of the $20^{th}$ century with the emerging of electronics many new musical instrument where made by the advantage of electronic circuits. Electronic based musical instruments used a signal synthesizer that is based on accurate time base, usually a quartz crystal, accurate time base eliminates the need for tuning the musical instrument.

Some musical instrument like organ and piano, that where played by keyboards, where replaced quit well by keyboard synthesizers that sufficiently mimic the sound generated by their counterpart analog musical instrument. Other instruments, especially string instrument where the strings are directly activated by the player fingers, like guitar or harp or by a bow and fingers like violin where not been replaced or mimicked adequately by their electronic synthesized instrument counterpart. The main reason for that is the richness of the sound produced by those instrument that where insufficient mimicked by the synthesizers.

The electric guitar which is one of the most popular instrument in modern music is actually did not change since its initial development in the early years of the $20^{th}$ century. The actual guitar structure is similar to a classic guitar while the electronic part is only pickup the vibration signal, amplify it and do some sound effect on it like distortion or modulating the original signal. The tuning problem is addressed today mostly by a stand alone tuner instruments. U.S. Pat. No. 3,881,389 filed on May 21, 1973, teaches an early electronic version of such tuner. Digital versions using digital signal processing and digital display are common and well known in the art.

Guitars that are integrating the tuner with motor drivers and adjust the string tension automatically are known as "Robot guitars" and are also start to be offered in recent years. U.S. Pat. No. 5,767,429 filed on Nov. 9, 1995, U.S. Pat. No. 6,184, 452 filed on Dec. 19, 1997, and U.S. Pat. No. 7,786,373 filed on Jan. 19, 2005 are example for patents that teach such solutions.

From a different direction there is on going effort to deliver a new guitars-like musical instrument that are based on pure synthesized audio signal. Those devices known as guitar synthesizers are actually similar to keyboard synthesizer that held like a guitar and enable playing the notes similar, more or less, to playing a guitar.

Many guitar synthesizers were suggested and developed. In early days finger location on the fret board was captured by press buttons. In more modern design the fret board is a touch sensitive surface. The strings in those guitar synthesizers are used only to pick the time and the strength of the pluck and the string vibrations generally are not used to synthesize the sound signal. Harmonics, palm mutes, hammer-ons (in which the fretting hand strikes the string onto the fret board), pull-offs, and pick slides are known guitar playing techniques that are not easily produced by guitar synthesizers. Usually, the strings lay only on the guitar body and not on the fret board. In some cases the string are replaced with "virtual strings"—an alternative way to pick the string pluck time. Those virtual strings can be mechanical buttons, laser light beams, touch surface, etc. An example of guitar synthesizer related patents are U.S. Pat. No. 8,003,877 filed on Sep. 26, 2008, U.S. patent application Ser. No. 12/115,519 filed on May 5, 2008, and U.S. patent application Ser. No. 11/731,449 filed on Mar. 30, 2007.

SUMMARY OF THE INVENTION

The present invention is an electronic tuner to musical instruments with vibration elements such as string. The invention change the fundamental frequency of the vibration elements electronically allowing both fine tuning and major tune change of the instrument, According to an aspect of some embodiments of the present invention there is provided a musical instrument comprising: (a) one or more strings; (b) a string vibration digitizer for at least one string; (c) an estimator that measures the fundamental vibration frequency of the string; and (d) a synthesized tuner, that conditioned upon at least the estimated frequency, generate an audio signal that comprises the characteristics of the original string vibration signal with a different fundamental frequency.

According to some embodiments of the invention, the musical instrument synthesized tuner is used to fine tune the string fundamental frequency to the audio signal with a frequency of a near musical note without changing the tension of the string.

According to some embodiments of the invention, the musical instrument synthesized tuner is used to tune the string fundamental frequency to the audio signal with considerably different frequency.

According to some embodiments of the invention, the musical instrument synthesized tuner is used to tune the strings to the audio signal comprises set of frequencies with exact frequency difference between corresponding the strings sounds.

According to some embodiments of the invention, the musical instrument comprising identical strings and the synthesized tuner is used to tune each the string to different frequency.

According to some embodiments of the invention, the musical instrument synthesized tuner is used to make a significant change in the range of frequencies produced by the instrument.

According to some embodiments of the invention, the musical instrument synthesized tuner is used to alter the fundamental frequencies produces by the string in different fret board positions.

According to some embodiments of the invention, the musical instrument is a guitar or a violin or a harp or a bowed string instrument or a plucked string instrument or a struck string instrument.

According to some embodiments of the invention, the musical instrument synthesized tuner comprises frequency down conversion followed by phase multiplication processing that furthered followed by frequency up conversion.

According to some embodiments of the invention, the musical instrument synthesized tuner comprises harmonics removal before the signal tuning and harmonics insertion after the signal tuning.

According to some embodiments of the invention, the musical instrument synthesized tuner comprises at least one of (a) frequency down conversion; (b) phase signal multiplication; (c) frequency up conversion; (d) frequency demodulation; (e) amplitude demodulation; (f) phase signal multiplication; (g) frequency modulation (h) amplitude modulation; (i) harmonics removal; (j) harmonics insertion; (k) frequency domain stretch, shrink and shift operations; and (l) time domain stretch, shrink and shift operations.

According to some embodiments of the invention, the musical instrument estimator estimates the string open string fundamental frequency or played fundamental frequency or both.

According to an aspect of some embodiments of the present invention there is provided a musical instrument comprising: (a) one or more vibrating elements; (b) a vibration digitizer for at least one the vibrating element; (c) an estimator that measures the fundamental vibration frequency of the vibrating element; and (d) a synthesized tuner, that conditioned upon at least the estimated frequency, generate an audio signal that comprises the characteristics of the original vibration signal with a different fundamental frequency.

According to an aspect of some embodiments of the present invention there is provided a method to tune musical instrument comprising: (a) digitizing the vibration of at least one vibrating element of the instrument; (b) estimating the fundamental frequency of the vibration; and (c) conditioned upon at least the estimated frequency, generate an audio signal that comprises the characteristics of the original vibration signal with a different fundamental frequency.

According to some embodiments of the invention, the method different fundamental frequency is a fine tune of the vibrating element fundamental frequency to the audio signal with a fundamental frequency of a near musical note.

According to some embodiments of the invention, the method different fundamental frequency is a considerably different frequency.

According to some embodiments of the invention, the method different fundamental frequency for each the vibrating element comprises a set of frequencies with exact frequency difference between each other.

According to some embodiments of the invention, the vibrating elements are identical and the different fundamental frequencies are different frequencies.

According to some embodiments of the invention, the method different fundamental frequencies make a significant change in the range of frequencies produced by the instrument. According to some embodiments of the invention, According to some embodiments of the invention, the musical instrument is a guitar or a violin or a harp or a xylophone or a bowed string instrument or a plucked string instrument or a struck string instrument.

According to some embodiments of the invention, the step of generating an audio signal comprises at least one of (a) frequency down conversion; (b) phase signal multiplication; (c) frequency up conversion; (d) frequency demodulation; (e) amplitude demodulation; (f) phase signal multiplication; (g) frequency modulation (h) amplitude modulation; (i) harmonics removal; (j) harmonics insertion; (k) frequency domain stretch, shrink and shift operations; and (l) time domain stretch, shrink and shift operations.

According to an aspect of some embodiments of the present invention there is provided a musical instrument comprising:

(a) plurality of identical vibrating elements; (b) a digitizer associated with each the vibrating element; (c) an estimator that measures the fundamental vibration frequency of the vibrating element; and (d) a synthesized tuner, that conditioned upon at least the estimated fundamental frequency of each vibrating element, generate an audio signal that comprises the characteristics of the original vibration signals with a different fundamental frequency for each the original vibration signal.

According to some embodiments of the invention, the synthesized tuner is used to make a significant change in the range of frequencies produced by the vibrating elements.

According to some embodiments of the invention, the musical instrument is a guitar or a violin or a harp or a bowed string instrument or a plucked string instrument or a struck string instrument.

According to some embodiments of the invention, the musical instrument is a xylophone or a drum set or a multi element percussion instrument or an organ or an accordion or a harmonica or a multi element wind instrument.

According to some embodiments of the invention, the synthesized tuner comprises frequency down conversion followed by phase multiplication processing that further followed by frequency up conversion.

According to some embodiments of the invention, the synthesized tuner comprises harmonics removal before signal tuning and harmonics insertion after the signal tuning.

According to some embodiments of the invention, the synthesized tuner comprises decomposing the signal to its components (fundamental and plurality of harmonics), tuning each component separately and compose the tuned components to generate the generated signal.

According to some embodiments of the invention, the decomposing is performed using a filter bank.

According to an aspect of some embodiments of the present invention there is provided a method for tuning signal of vibrating element comprising:

(a) digitizing the vibration of the vibrating element; (b) estimating the fundamental frequency of the vibration; and (c) conditioned upon at least the estimated fundamental vibration frequency, generate a signal that comprises the characteristics of the original vibration signal with a different fundamental frequency.

According to some embodiments of the invention, the step of generating the signal comprises frequency down conversion followed by phase multiplication processing that further followed by frequency up conversion.

According to some embodiments of the invention, the coefficient of the phase multiplication is determined by the ratio between the original vibration fundamental frequency and the desired fundamental frequency.

According to some embodiments of the invention, the step of generating the signal comprises at least one of (a) phase unwrapping; (b) frequency demodulation; (c) amplitude demodulation; (d) instantaneous frequency signal multiplication; (e) frequency modulation; (f) amplitude modulation; (g) harmonics removal; (h) harmonics insertion; (i) frequency domain stretch, shrink and shift operations; and (j) time domain stretch, shrink and shift operations.

According to some embodiments of the invention, the step of generating the signal comprises harmonics removal before signal tuning and harmonics insertion after the signal tuning.

According to some embodiments of the invention, the step of generating the signal comprises decomposing the signal to its components (fundamental and plurality harmonics), tuning each component separately and compose the tuned components to generate the tuned signal.

According to an aspect of some embodiments of the present invention there is provided an electronic device for tuning signals comprising: (a) port for signal input; (b) an estimator that measures the fundamental frequency of the signal; (c) a synthesized tuner, that conditioned upon at least the estimated fundamental frequency, generate an output signal that comprises the characteristics of the original signal with a different new fundamental frequency; and (d) port for outputting the tuned signal.

According to some embodiments of the invention, the step of generating the signal comprises frequency down conversion followed by phase multiplication processing that further followed by frequency up conversion.

According to some embodiments of the invention, the coefficient of the phase multiplication is determined by the ratio between the original vibration fundamental frequency and the desired fundamental frequency.

According to some embodiments of the invention, the step of generating the signal comprises at least one of (a) phase unwrapping; (b) frequency demodulation; (c) amplitude demodulation; (d) instantaneous frequency signal multiplication; (e) frequency modulation; (f) amplitude modulation; (g) harmonics removal; (h) harmonics insertion; (i) frequency domain stretch, shrink and shift operations; and (j) time domain stretch, shrink and shift operations.

According to some embodiments of the invention, the step of generating the signal comprises harmonics removal before signal tuning and harmonics insertion after the signal tuning.

According to some embodiments of the invention, the step of generating the signal comprises decomposing the signal to its components (fundamental and plurality harmonics), tuning each component separately and compose the tuned components to generate the tuned signal.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well.

BRIEF DESCRIPTION OF THE DRAWINGS

Some embodiments of the invention are herein described, by way of example only, with reference to the accompanying drawings. [IF IMAGES, REPHRASE] With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
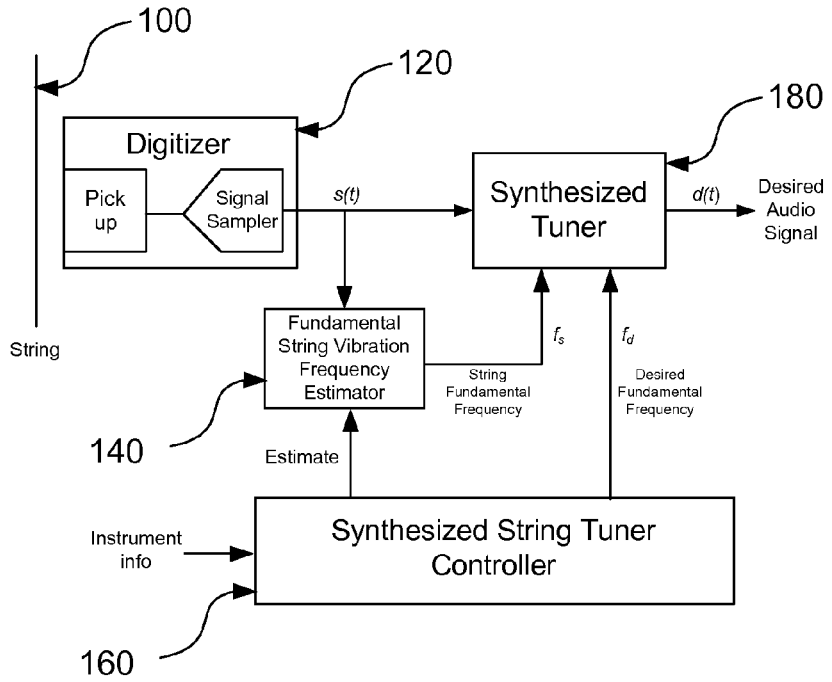
FIG. 1 is a block diagram of a conceptual single string minimal system.

The present invention, in some embodiments thereof, relates to musical instruments and, more particularly, but not exclusively, to a string based musical instruments.

String based musical instrument allows the player to have a rich and delicate control of the sound produced by the instrument. Playing techniques in guitar such as pinch harmonics, tapped harmonics, palm mutes, hammer-ons, pull-offs, pick slides and others are not adequately produce by guitar synthesizers. MIDI type guitar synthesizer and the guitar controllers that controls MIDI type guitar synthesizer pick only the pluck time and pluck strength as well as the fret position or the fundamental tone to be played. On the other hand standard electronic guitar can pick all the richness of the string sound but is subjected to disadvantages of analog musical instrument such as constant need for tuning the strings as well as limitation in the size of the guitar, the location of frets, the type of the strings, the reliability of the strings, etc.

The current invention bridges between those two ends and provide a more flexible string instrument that eliminate the need of tuning (as in digital synthesizers) and provide much more flexible design constrains for the musical instrument designer. Length of the strings, the frets locations and the type of strings are not obey hard limitation and can be chosen by other requirements, such as comfort or reliability, and they are not limited to the tone the instrument should produce.

The principle idea behind the invention is to decompose the string sound to its two components: the fundamental frequency and all other string sound artifacts such as harmonics, amplitude modulation, frequency modulation etc. After this separation is performed, a digital synthesizer recomposes a new sound signal with the same string sound artifacts but carried on a different fundamental frequency.

As used herein, the term fundamental vibration frequency, or in brief fundamental frequency, is the lowest frequency of the vibration of a string.

This decomposition-recomposition arrangement opens the door for real time automatic digital tuning system. The string does not have to be tuned accurately to a specific fundamental frequency. The tuner system will measure the actual string fundamental frequency and based on that frequency decompose and recomposes the same string signal but with different fundamental frequency.

The element that decomposes the string signal to its components and recomposes the signal with different new fundamental frequency is referred hereinafter as synthesized tuner. The output of the synthesized tuner is referred hereinafter as the synthesized tuned signal.

The freedom created by ripping the link between the string frequency and the output signal frequency opens the door for a new range of features and new musical instruments.

Using synthesized tuner one can change the instrument tuning (the tuning ladder of multi string musical instruments) instantaneously. For example, in guitars the guitar tuning may be changed by a press of a button, from standard tuning (E-A-D-G-B-E) to open C tuning (C-G-C-G-C-E) without tuning the strings at all i.e., without changing the tension on the strings.

Synthesized tuner can be used as a virtual capo. If, for example, one put a capo on the fifth fret it change the open string guitar tuning from standard tuning (E-A-D-G-B-E) to (A-D-G-C-E-A). With synthesized tuner, this can be done by pressing a button without putting a capo on the guitar neck. The playable neck area in this case is not reduced as it is in a real capo usage and the full fret board area is usable for playing.

One well known problem in string instruments is the need to use different types (materials) and different size (diameter) of strings. Usually the thinnest string is both less comfortable to play and tends to snap. Using the invention, all string can be made from the same material and with the same diameter. String can be selected for most comfortable, most reliable and for giving the best sound performance without taking in consideration the actual open string fundamental frequency. Furthermore, the player can set the tension of the string to be the one that give him the best feeling or best sound and this tension do not relate to the actual fundamental frequency output sound of the string. Furthermore, from signal processing considerations that will be explained later, the processing delay is inversely related to the lowest fundamental frequency of the vibrating elements. Having vibrating elements with higher fundamental frequencies then the actual played one may decrease the delay to the sound imposed by the digital signal processing.

As used herein, the term open string refers to the state where the string length is maximal. The term open string fundamental frequency refers to the fundamental frequency of the string when the string is open, i.e., in maximal length. Unless otherwise stated or can be implicitly understood from text, the term fundamental frequency will be associated with the open string fundamental frequency. The term "played fundamental frequency" is the fundamental vibration frequency of a string in specific, usually not open, playing condition. This term refers to instrument that during play the player shortens the string length and therefore causes a change in the fundamental frequency of the string. Note that played fundamental frequency may be equal to open string fundamental frequency in the case where the player plucks on open string.

As used herein, the term signal component, or in brief component, means either the fundamental signal or any single harmonic signal of the vibrating signal.

The string lengths dictated by fret board, i.e., the fret board spacing is related to the physical formula that connect between the string length and the fundamental frequency. To adjust the tone of a string a full octave the fret board need to have length of at least half the open string length. Furthermore, to play notes according to western tonal system the fret spacing is getting smaller as the frequency is getting higher so fret spacing is usually to wide near the guitar head and too small near the guitar body. The invention synthesized tuner provides the ability to build fret boards in any length and any spacing, including linear spacing. The played fundamental frequency deviations from the required musical notes (generated by the arbitrary fret spacing) corrected in this case in real time by the synthesized tuner. The out of tune of the string vibrations, caused by the actual fret spacing, is compensated as long as the actual activated fret is known. The activated fret can be detected either directly by locating the fingers on the fret board, e.g., using touch surface, or indirectly by measuring the played vibration frequency of the string.

Before explaining at least one embodiment of the invention in detail, it is to be understood that the invention is not necessarily limited in its application to the details of construction and the arrangement of the components and/or methods set forth in the following description and/or illustrated in the drawings and/or the examples. The invention is capable of other embodiments or of being practiced or carried out in various ways.

Synthesized Tuner Implementation Examples

Referring now to the drawings, FIG. 1 illustrates the construction and operation of a conceptual single string synthesized string tuner. String 100 is the musical instrument string. String 100 vibrations are digitized by digitizer 120. The output of digitizer 120 is a digital string signal denoted by s(t). The string signal s(t) is an input to fundamental string vibration frequency estimator 140. Fundamental string vibration frequency estimator 140, for abbreviation refer hereafter as frequency estimator, perform the estimation under the control of synthesized string tuner controller 160 which is a part of the musical instrument controller and optionally receive information regarding the instrument setup and status. For example, synthesized string tuner controller 160, for abbreviation refers hereafter as tuner controller, receives a command from the musician to perform tuning of the instrument. During tuning, tuner controller 160 instructs frequency estimator 140 to measure the string fundamental frequency while the musician plucks the open strings. Alternatively, frequency estimator 140 measures continuously the played fundamental frequency of the string. Using the current fingers positions over the fret board and/or the fret board geometry of the instrument and by analyzing the intervals that the string signal is stable, i.e., not in initial pluck transient (attack) and not in vibration finale transient (decay), frequency estimator 140 determine first the played fundamental vibration frequency of the string. By matching the allowable ratio between the played fundamental frequency and the open string fundamental frequency, frequency estimator 140 calculates the open string fundamental frequency. The open string fundamental frequency is denoted by f. Based on the instrument setup, tuner controller 160 sets the desired open string fundamental frequency for the string, denoted by $f_d$. For example, if the string is the highest string of a guitar with standard guitar tuning, the string fundamental frequency should be E4, i.e. 329.63 Hz. Tuner controller 160 in this case will set the desired open string fundamental frequency of the string to 329.63 Hz. Synthesized Tuner 180 gets the digitized string signal s(t) and transform it to the desired sound signal d(t). This digital transformation is based on the measured string fundamental frequency $f_s$ provided by frequency estimator 140 as well as the desired fundamental frequency $f_d$ provided by tuner controller 160. The digitizer sampling rate is based on accurate time base such as crystal oscillator hence it is known and accurate. The string fundamental frequency can be estimated with relative high accuracy. The desired fundamental frequency is known exactly and hence the desired signal tune accuracy is similar to tone accuracy achieved by known in the art music synthesizers. Even if the string is not tuned for the desired output sound, tune is not required for the string and the desired tone will be played in all finger position over the fret board.

The term digitizer refers to means that capture the vibrations and convert them to signal in digital form. Digitizer 120 are well known in the art and comprises string vibration pickup that convert the vibrations to eclectic signals and a sampler, i.e. Analog to digital converter that convert the analog signal to a stream of digital bits that can be manipulated by digital signal processing. Any other vibrating elements other then string may be used with digitizer 120. Any type of pickup technology can be used. In particular, magnetic pickups that are popular in electric guitars can be used. Other pickups such as piezoelectric, optic and acoustic, i.e. microphones, may be used as well. Any kind of ADC can be used in digitizer 120. Flash, successive approximation and sigma-delta ADC technology can be used. The sampler accuracy, the number of bit as well as the sampling rate, is set to meet the accuracy and number of harmonics that are desired to be processed by the instrument and may change from instrument to instrument. In general, Nyquist criteria for the sampling rate versus the maximum signal frequency should be met. Frequency estimators are well known in the art in many fields and many algorithms are available. Tuner controller 160 is a general type controller and is well known in the art. Any microprocessor, micro controller or discrete digital logic can implement tune controller 160.

The implementation details of synthesized tuner 180 will be provided next. It is to be understood that the invention is not necessarily limited in its application to the details of construction of synthesized tuner 180 as well as the arrangement of the components 140 160 and 180 and the partition between them and/or methods set forth in FIG. 1. The invention is capable of other embodiments or of being practiced or carried out in various ways. For example, synthesized tuner 180 may get only the difference or the ratio between $f_s$ and $f_d$. The string estimator can be implemented as part of the synthesized tuner, etc.

Figure 2:
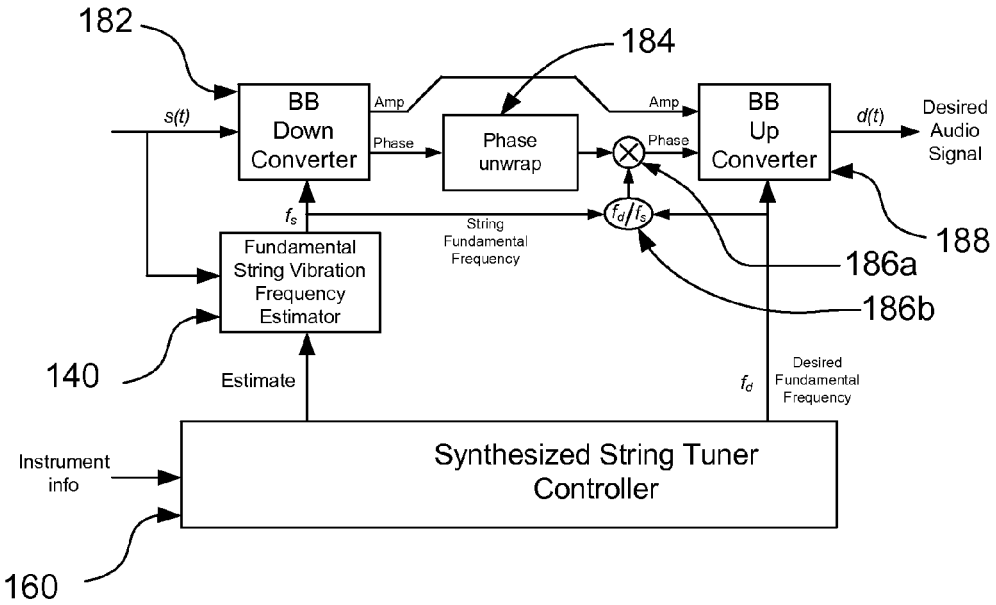
FIG. 2 is a block diagram of simple synthesized tuner in accordance with an exemplary embodiment of the invention.

Reference is made now to FIG. 2. FIG. 2 illustrates a simple embodiment of synthesized tuner 180 of FIG. 1. Frequency estimator 140 and tuner controller 160 were described in FIG. 1. Synthesized tuner 180 is comprised from elements 182 to 188. Baseband down converter 182 gets the string signal s(t) and down convert it to complex envelope baseband signal. The down conversion is done using the estimated fundamental string vibration frequency $f_s$. Formally the complex envelop baseband signal, $S_{BB}$ is given by $$S_{BB} = \frac{1}{\sqrt{2}}[s(t) + j\hat{s}(t)] \cdot \exp(-j2\pi f_0 t)$$

Where $\hat{s}(t)$ is the Hilbert transform of s(t). The complex baseband signal amplitude is transferred directly to the baseband up converter 188. This complex envelop signal retain all information of the string vibration amplitude including the initiation phase after plucking The complex envelop signal does not contain the information of the original fundamental frequency.

The complex baseband signal phase is manipulated by elements 184, 186*a* and 186*b* before transferred to baseband up converter 188. While a simple down and up conversion, or equivalently performing a single frequency shift is optionally possible in some scenarios and may be used as well, the reason for the additional phase processing will be presented next. The baseband signal phase is transferred to phase unwrap 184. Phase unwrap elements are well known in the art and they regenerate a continuous phase signal that illuminates the 2π jumps occurring in complex BB representation. For example, for a pure sine wave signal, the phase unwrap output is a straight line with a slope proportional to the sine wave frequency. The phase unwrap signal is multiplied by multiplier 186*a* with a coefficient calculated by divider 186*b*. The coefficient is calculated by dividing the desired frequency $f_d$ with the string fundamental frequency $f_s$. The multiplied phase signal is transferred to the baseband up converter 188 and using the desired fundamental frequency the up converter 188 creates the synthesized tuned output signal. Formally the output signal is given by $$d(t)=\text{Real}\{S_{BB}'\cdot\exp(j2\pi f_d t)\}$$

Where $S'_{BB}$ is the modified complex envelop and d(t) is the desired output signal.

To better understand how this embodiment achieves its goal lets take for example the highest string of standard guitar. In standard guitar the higher string should be tuned to 329.63 Hz. Lets assume in our case that the string is not tuned and its open string fundamental frequency is 310 Hz. Frequency estimator 140 will measure the string fundamental frequency to be 310 Hz. When we pluck the open string, digitizer capture the string signal and down converter 182 down convert the signal using the estimated fundamental frequency of 310 Hz. After converting to BB when the string signal is stabilize to its fundamental frequency the baseband signal frequency will be zero. Tuner controller 160 set the desired frequency to 329.63 Hz and since the phase of the baseband signal is constant (baseband frequency is zero), the output signal for this string (in open state) will be 329.63 Hz as required, i.e., the output signal is tuned.

Consider now the case the musician plunked on the string with a finger set on the 12th fret. In this case, the string will vibrate exactly on twice the frequency, i.e., the played fundamental frequency is 620 Hz (In 12th fret the string length is half). The frequency of the BB signal will be 620−310=310 Hz. Without the phase processing the output frequency will be the base band frequency plus the desired fundamental frequency, 310+329.63=639.63 Hz. However for tuned string the frequency, in this case, should be 2×329.63=659.26 Hz. With the phase processing, divider 186*b* is set the phase multiplier coefficient to 329.63/310=1.0633. The phase multiplier 186*a* adjusts the base band frequency to 310·1.0633=329.63 Hz and the output signal frequency will be 329.63×329.63=659.26 Hz as desired.

In similar fashion, any position on the fret board that the musician presses its finger on, the 310 Hz un-tuned string frequency will be converted by the synthesized tuner to an output signal with frequency that is identical to the frequency that was produced by the string if it was tuned to 329.63 Hz.

If the string fundamental frequency is higher then the desired fundamental frequency, for example the string frequency is 360 Hz, the multiplier coefficient will be less then one and the frequencies after the multiplier will be scaled down respectively.

The synthesized tuned output signal contains all the characteristics of the original signal including its amplitude, time profile, initial and fading characteristics as well as the frequency modulations and harmonics. However, phase multiplication is not linear and might distort the output signal. As rule of thumb the bigger the multiplication coefficient the bigger the distortion. Furthermore, the phase multiplication has capture effect which means the frequency shift is based on the fundamental frequency and the string signal harmonics will shift based on the fundamental frequency.

There are many ways to reduce some of the distortions created by this simple embodiment. One way is to down convert the signal to frequency close to zero. In this case, the frequency estimator, based on its own measurements or based on a side information of the finger position on the fret board, transfer to the down converter not the open string fundamental frequency but the played fundamental frequency $f_s(n)=f_s\cdot 2^{(n/12)}$ and the up converter gets instead of $f_s$ the up conversion frequency of $f_d(n)=f_d\cdot 2^{(n/12)}$ where n is the current fret position or the note index. The phase multiplier coefficient still set to be $f_s/f_d$.

As used herein, the term note index refers to an integer number have injective function to the ratio between the open string fundamental frequency and the played string fundamental frequency. While the mapping can take any values, in western music tonal system and most of the musical instrument the mapping between the note index n and the frequencies ratio is $2^{(n/12)}$ and each increment in the index represent half tone increment.

Figure 3:
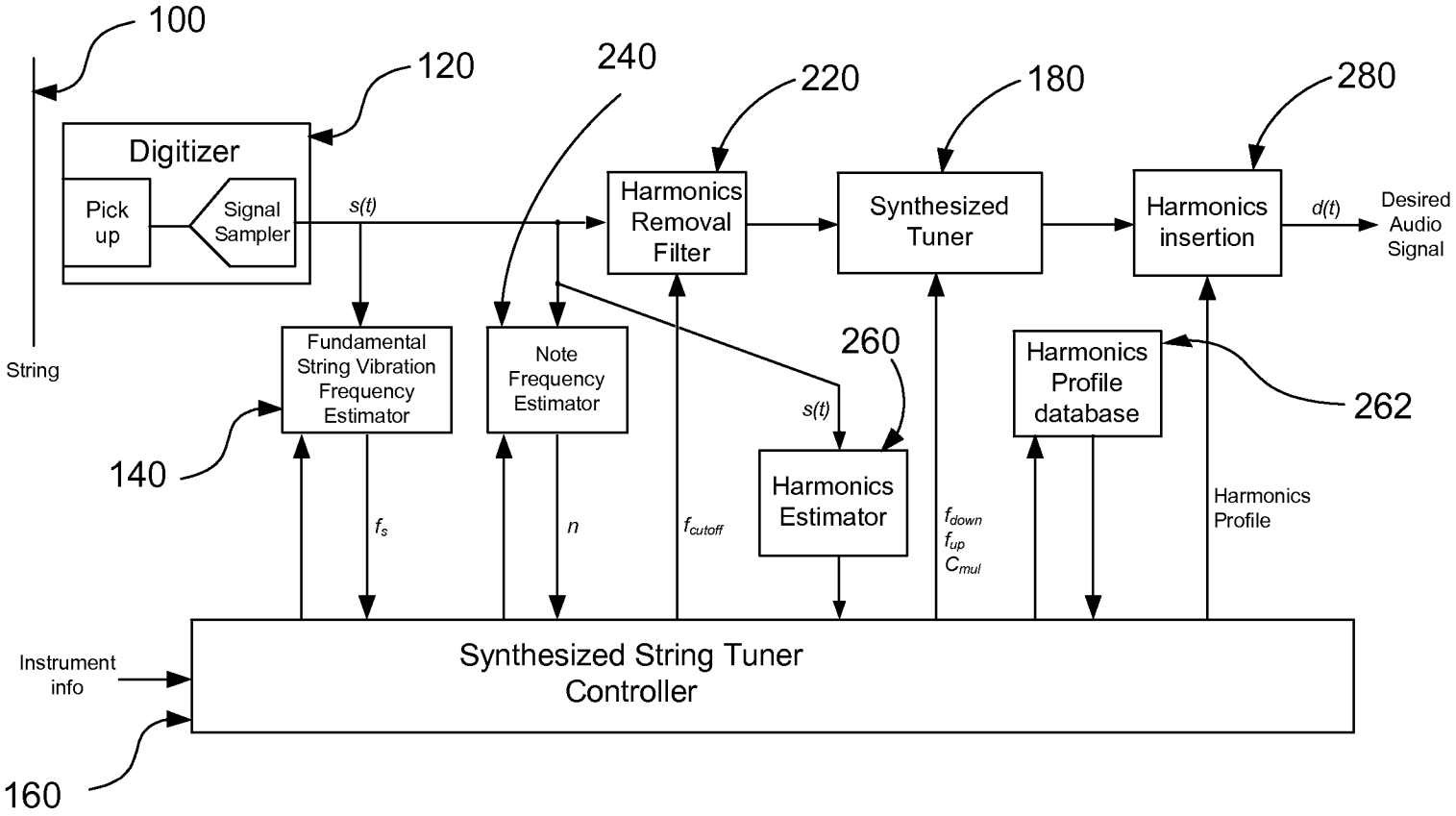
FIG. 3 is a block diagram of single string more advanced system.

Another approach to reduce the distortions is to decompose the string signal from its harmonics. Since the harmonics frequencies are at least twice the fundamental frequency it is quit simple to filter out the harmonics whenever the fundamental frequency is known. FIG. 3 illustrates another block diagram of string synthesizer tuner that combines both note index estimator and harmonics removal (filtration) before performing the synthesized tuning and harmonic re-insertion after performing the synthesized tuning In the figure, String 100, Digitizer 120, Frequency estimator 140 and Tuner controller 160 are functioning in similar manner as in previous embodiments. Note frequency estimator 240 estimates the note index of that currently playing tone. Note index is estimated based on the fundamental frequency estimator and prior knowledge of the frets geometry. Tuner control 160 provides to note frequency estimator 240 the estimated open string fundamental frequency and note estimator 240 continuously and instantaneously estimate the played fundamental frequency and search for the closest possible frequency that meet the fret geometry. Note estimator 240 transfers the note index n to tuner control 160. In western instrument tonal system note index n is zero or positive integer (0, 1, 2, 3, . . . ) and the actual note frequency is $2^{(n/12)}$ multiplied by the desired fundamental string frequency. Optionally or alternatively, non western tonal system is used. Open string fundamental frequency estimator 140 and note frequency estimator 240 are closely related and they can share resources and exchange directly information as illustrated in the figure. Alternatively, a single estimator performing the function of both fundamental frequency estimator 140 and note frequency estimator 240 is implemented.

To reduce synthesized tuner 180 distortions the implementation illustrated in the current embodiment removes the harmonics from the string signal. The string signal, s(t), is transferred to harmonics removal filter 220. The cut-off frequency of the harmonics removal filter 220 is set by tuner controller 160 based on the fundamental frequency estimator 140 measurements and optionally based on the note frequency estimator 240 measurements as well. The "striped" string signal (without the harmonics) is transferred to synthesized tuner 180. Synthesized tuner 180 is similar to the synthesized tuners discussed above and the down conversion frequency, up conversion frequency and the phase multiplication coefficient is provided by tuner controller 160. The string signal, s(t), is optionally transferred to harmonics estimator 260. Harmonic estimator estimates the actual harmonics produced by string 100. Estimate of harmonics is well known in the art and can be done by measuring the actual harmonic amplitude and phase coefficients of the signal in the frequency domain or by averaging several cycles of the signal in the time domain. Several other techniques can be used as well. The harmonic data, referred hereinafter as harmonic profile, is stored and used to insert the harmonics back to the signal by harmonics insertion unit 280. The insertion can be done by applying non linear function that regenerate the desired harmonics to the signal or by directly replace each sine wave between two successive zero crossing with the desired time domain pattern. Tuner controller 160 instructs harmonic insertion unit 280 to generate harmonics that are similar to the harmonics that was removed from the original signal or alternatively, instruct harmonic insertion unit 280 to generate harmonics taken from harmonic profile database 262. Harmonic profile database 262 stores sampled signals taken from different "golden model" of musical instruments. Additionally or optionally, harmonic profile database 262 stores standard MIDI sound waveforms.

Figure 4:
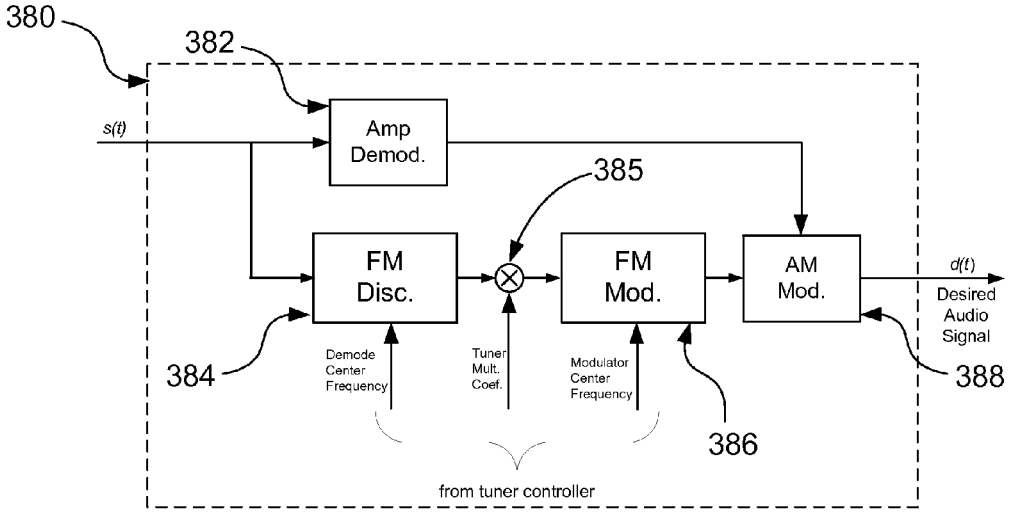
FIG. 4 is a block diagram of modulator demodulator based synthesized tuner in accordance with an exemplary embodiment of the invention.

According to another embodiment of the invention, the synthesized tuner decompose the signal to FM and AM components, adjust the FM signal and re-modulate the signal back with a different FM center frequency. FIG. 4 illustrates synthesized tuner using this alternative embodiment. Synthesized tuner 380 transfer the input signal to amplitude demodulator 382 and FM discriminator, i.e. FM demodulator, 384. The FM discriminator 384 center frequency is set by the tuner controller in accordance to the string estimated frequencies. This can be either the open string fundamental frequency or played string fundamental frequency. The FM demodulated signal is transferred to multiplier 385. The multiply coefficient is set by the tuner controller. The coefficient is set to the quotient between the desired string fundamental frequency and the actual measured sting fundamental frequency. Multiplier 385 output is transferred to FM modulator 386 as the modulating signal. The center frequency of FM modulator 386 is set according to the desired output fundamental frequency of the string. The output of FM modulator 386 is transferred to AM modulator 388. AM modulator 388 gets its modulating signal from amplitude demodulator 382. The output of AM modulator 388 is the desired output signal.

Figure 5:
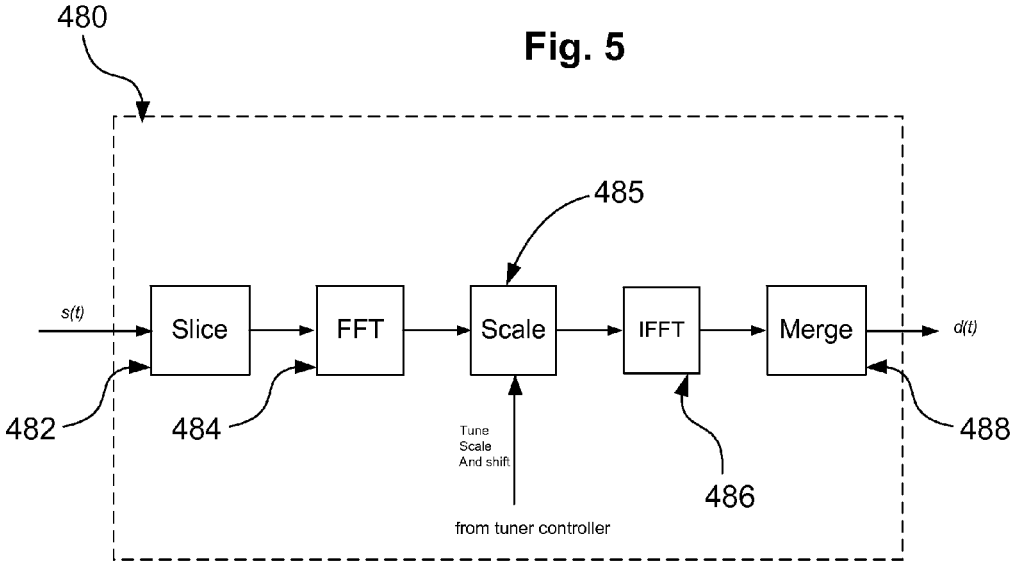
FIG. 5 is a block diagram of FFT based synthesized tuner in accordance with an exemplary embodiment of the invention.

According to yet another embodiment of the invention, the signal tuning is done in the frequency domain. The input signal is sliced and transferred to an FFT. The tuning is done in the frequency domain. Then the signal transformed back to time domain using IFFT. FIG. 5 illustrates synthesized tuner using this alternative embodiment. Synthesized tuner 480 transfer the input signal to slicer 482. Slicer 482 collects a block of samples, optionally preprocess the block, and transfer the block to the FFT 484. The FFT 484 results are transferred to Scaling block 485. Scaling block 485 shifts the frequency domain signals (analogous to frequency up or down convert) as well as scales the frequency domain signals, i.e. stretch or shrink the spectrum (analogous to phase multiply or time domain shrink or stretch respectively). Stretching the spectrum generates higher frequency string vibration effect and shrinking the spectrum generates lower frequency string vibration effect. The scaling is done using interpolation on the frequency FFT samples (bins). When scaling block 485 stretches the spectrum the higher frequencies that fall out of the frequency range are discarded. With proper frequency sample rate those frequencies are anyway greater then the hearing bandwidth. When scaling block 485 shrinks the spectrum the higher range is padded with zeros.

The scaling factor as well as the shift is set by the tuner controller in accordance to the string estimated and desired fundamental frequencies. In an exemplary embodiment of the invention, Scale unit 485 gets the scale and shift instructions from the tuner controller. Additionally or alternatively, the scale is set by tuner controller, and the shift is determined automatically in scaling block 485 by setting the shift to be the shift that provides an harmonic pattern. While the scale provide the correction that need to be done for the fundamental frequency, the shift provide the frequency offset that need to induced to the signal to generate an harmonic pattern that would mimic a similar harmonic pattern that would be generated if the string was tuned to the desired fundamental frequency. The scaled version of the spectrum is transferred to IFFT 486. The IFFF output is transferred to merging block 488. Merging block 488 takes care for creating smooth transition between the slices. This can be done by multiplying the slice with proper phase or other smoothing techniques.

Figure 6:
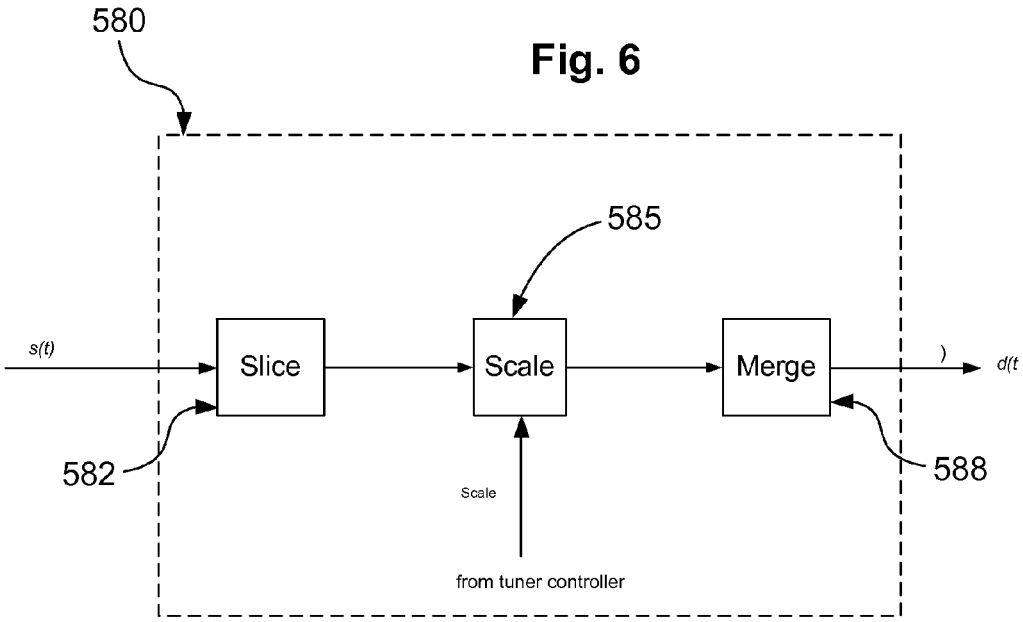
FIG. 6 is a block diagram of time based processing synthesized tuner in accordance with an exemplary embodiment of the invention.

According to yet another embodiment of the invention, the signal tuning is done directly on the time domain. The input signal is sliced and transferred to a time scale unit. The time scale unit stretch or shrink the signal in time. The scale unit transfers the signal to merge unit that connect the time slices smoothly. FIG. 6 illustrates synthesized tuner using this alternative embodiment. Synthesized tuner 580 transfer the input signal to slicer 582. Slicer 582 transfers the slice to scale unit 585. The scale unit stretch or shrink the signal in time. Stretching the signal in time lowers the string vibration frequency. Shrinking the signal in time makes string vibration frequency higher. Scaling is done using interpolation or extrapolation of the samples and is well known in the art. Two effects should be take care during this process, first the slice time duration in the slice unit output should be the same as the slice duration in the slice unit input. Second, low frequency characteristics of the signal created by the player finger, like the pluck rate, should not be scaled. To overcome those problems the slice is first filtered with very low frequency filter (few Hertz) and a low frequency version of the amplitude is generated. Then the slice is sliced again to three parts: (1) beginning, (2) middle and (3) end of the slice. In case of shrinking, the sub-slices are shrunk and place in the beginning, middle and end of the output slice. Since the sub-slices were shrunk, there are two gaps in the output slice. The gaps are filled with cycles from both sides until the gap is closed. If there is discontinuity in the meeting points, the start slice and the end slice are moved outwards until phase continuity achieved. Then the outer edges are truncated. The last step is to correct, i.e. modulate, the amplitude of the created slice according to the signal envelop and the low frequency filtered signal.

When the slice is stretched, scale unit 585 is also slicing the slice to three sub-slices. Each slice is stretched and put in place in the output slice. Since the sub-slices were stretched, there are two overlap regions in the output slice. The overlaps are removed and the meeting points, like in the shrink case, are corrected. The outer sub-slices are moved to create phase continuity. Again, this step is followed by a step that correct the amplitude of the generated slice according to the envelop of the signal and the low frequency filtered signal.

The output slice of the scale unit 585 is transferred to merge unit 588 that takes care to smoothly connect the slices.

Time domain processing may be done in various ways and various slicing techniques. In an exemplary embodiment of the invention, time domain scaling is done on the fly without slicing. In an exemplary embodiment of the invention, slicing is done with variable slicing block size according to the signal characteristics.

While decomposing the fundamental signal from the signal harmonics provide a mechanism for simple and easy tuning of the vibration element it is sometime desired to tune all harmonics and actually build the desired tuned signal, d(t), based on the tuned fundamental component and one or more tuned harmonics components. This can be done using a bank of filters that decompose each component (fundamental or harmonic), performing a synthesized tuner for each component and recompose all the components to form the desired tuned signal, d(t).

Figure 12:
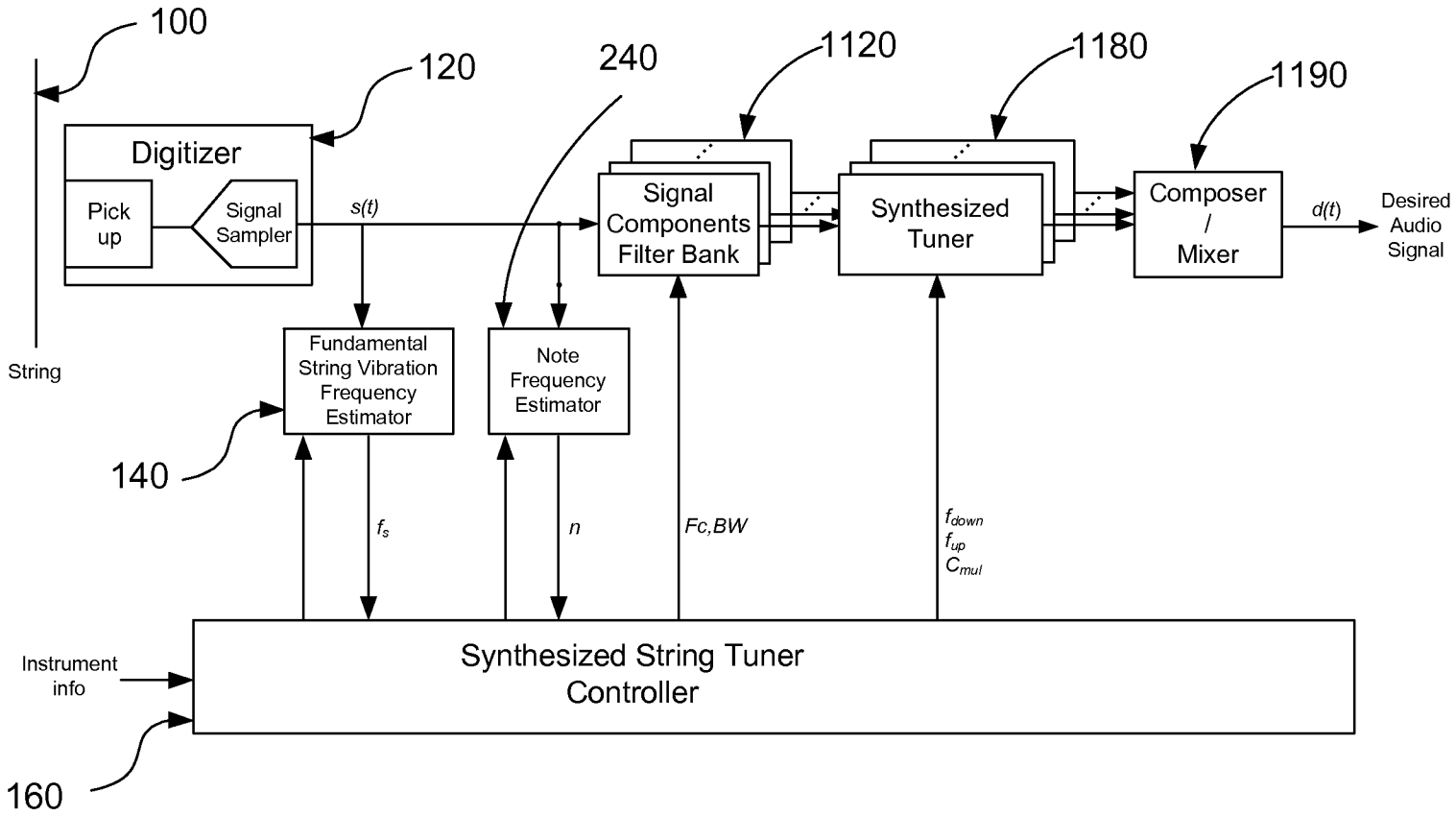
FIG. 12 is a conceptual block diagram of component decomposing and tuning each component separately in accordance with an exemplary embodiment of the invention.

Reference is made now to FIG. 12. FIG. 12 illustrate a conceptual block diagram of the synthesized tuner system comprising a filter bank to decompose the signal to its components and plurality of synthesized tuners to tune each signal component. String or any other vibrating element 100 is digitized by digitizer 120. The output of digitizer 120 is a digital input signal denoted by s(t). The fundamental string vibration frequency is estimated by fundamental frequency estimator 140. Optionally, note frequency estimator 240 estimates the note index of that currently playing tone. Synthesized string tuner controller 160 controls the musical instrument including all the blocks related to signal tuning In the embodiment illustrated in FIG. 12 the input signal s(t) is transferred to a filter bank 1120. Filter bank 1120 contains plurality of filters each has different center frequency, $f_c$, and optionally different bandwidth, BW. Tuner controller 160 set the center frequency and the bandwidth of each filter in filter bank 1120. The setup of filter bank 1120 may change over time based on the temporal information provided to tuner controller 160. In specific, the information from fundamental frequency estimator 140 and note frequency estimator 240 may change filter bank 1120 setup.

In an exemplary embodiment of the invention, The center frequency of the first filter in filter bank 1120 is set to the current played fundamental frequency and the center frequency of other filters in filter bank 1120 are set to the frequency of the harmonics. In an exemplary embodiment of the invention, the bandwidth of the filters in filter bank 1120 is set to the fundamental frequency. In this case the cutoff frequency of each filter is in the middle between any two signal component frequencies. Optionally or alternatively, the bandwidth of the filters in filter bank 1120 is set to be les then the fundamental frequency. Each output of a filter in filter bank 1120 is transferred to a matching synthesized tuner 1180. Synthesized tuner 1180 is using one of the techniques revealed above. The output signal of the filters in filter bank 1120 may be either in pass-band format or in base-band format depending on the type of synthesized tuner 1180 being used. The synthesized tuner 1180 output signal is generated based on the information provided by tuner controller 160. The information may include, $f_{down}$, the center frequency of the down conversion, $f_{up}$, the center frequency of the up conversion, i.e., the desired frequency and $C_{mul}$, the coefficient related to the ratio between the string actual frequency and the desired frequency.

The output of all synthesized tuner 1180 are composed, i.e., combined or mixed together, by composer/mixer 1190. The composing step is a straight forward processing of adding all signals together to form the desired signal d(t).

While the concept of decomposing the signal to its fundamental plus harmonics, performing tuning operation on each component and then composing the tuned components to a desired input signal is covered in principle in the above illustration, there are many practical ways to convey it, and many implementation variants may be used. In the following sections we provide some examples of several more efficient ones.

Filter bank may be implemented as a simple array of IIR of FIR filters. However, a straight forward implementation of a filter bank 1120 might be computationally inefficient. Many types of more efficient filter bank 1120 implementations are known in the art. A partial list includes multi step quadrature mirror filter bank, poly-phase filter bank, simple FFT filter bank and WOLA based filter bank. The common disadvantage for those techniques is that they imply rigid restrictions on the center frequencies and the bandwidth of the filters as well as impose artifacts like aliasing and major reduction in the filters output sampling rate. Reduction in the filters output sampling rate have the advantage of reducing the processing requirements but can provide other disadvantages such as ambiguity and imperilments in the synthesized tuning process.

To better understand the limitations and the way to overcome them, let's first provide an exemplary embodiment of using the simplest and most efficient filter bank implementation using an FFT. If one transfer the input signal s(t) to an FFT with length N, the FFT provide N/2 filter outputs (assuming s(t) is real and only half of the outputs carried real different data and the other half are redundant). Each filter has bandwidth of Fs/N. The output sampling rate is also Fs/N and the center frequency of each filter in the bank is n·Fs/N. To ensure that no filter bank, i.e., FFT bin, pass energy from two adjacent signal components, the FFT bin spacing should be smaller then the lowest possible fundamental vibration frequency. For example, if we assume classical guitar, the lowest string in open state has frequency of about 80 Hz. If the sampling rate is 44,100 Hz, the FFT size should be larger then 551.25 so the actual $2^n$ FFT size should be 1024. However, if we work with the highest guitar string, the open string fundamental frequency is about 330 Hz and the FFT size should be larger then 133 or a 256 bin FFT may be used.

Using an FFT directly coupled to the input signal will cause the actual played signal and all its components (fundamental+harmonics) to enter into the filters in the filter bank in arbitrary frequency offset related to the filters center frequencies. It is well known in art that if the signal is not near the center of the filter in a simple FFT filter bank there is a strong leakage between the filters in the filter banks There is also a large degradation in signal strength near the filter cutoff frequencies. Moreover near the cutoff area, since the filter output rate is Fs/N there is an ambiguity in the phase signal that leads to uncertainty in the frequency offset of the signal that pass through the filter. From all above, as is simple FFT can not give adequate performance for filter bank synthesized tuner system.

There are two possible ways to overcome this and improve performance: (1) to synchronize the FFT filter banks to the input signal; and (2) to increase filter bank output sampling rate and improve filter bank frequency response.

Synchronizing the FFT filter bank is based on the knowledge or the estimation of the fundamental frequency of input signal s(t). If the input signal sample rate is converted to a multiple time of the input signal fundamental frequency, the signal components will reside in proximity to the center of each filter in the FFT filter bank. The fundamental open string frequency of a string is changing very slowly so such an approach fits very well to a vibrating element that do not tuned by the player like in piano, harp or other multi element musical instrument. In a guitar and some other instruments playing different notes on the string is changing the fundamental string frequency to fast to update the filter continuously. Unfortunately the played fundamental frequency, $f_s(n)=f_s\cdot 2^{(n/12)}$, inside a single octave do not fit well to a single FFT filter bank. However, signals that are octave apart fits very well to the same FFT and the FFT filter bank in this case will have a signal component in every second filter output instead of one. To cope with this problem a system using twelve conversion rates, i.e., twelve conversion rate units, and twelve FFT filter banks is suggested. The block diagram of such system is provided in FIG. 13.

Figure 13:
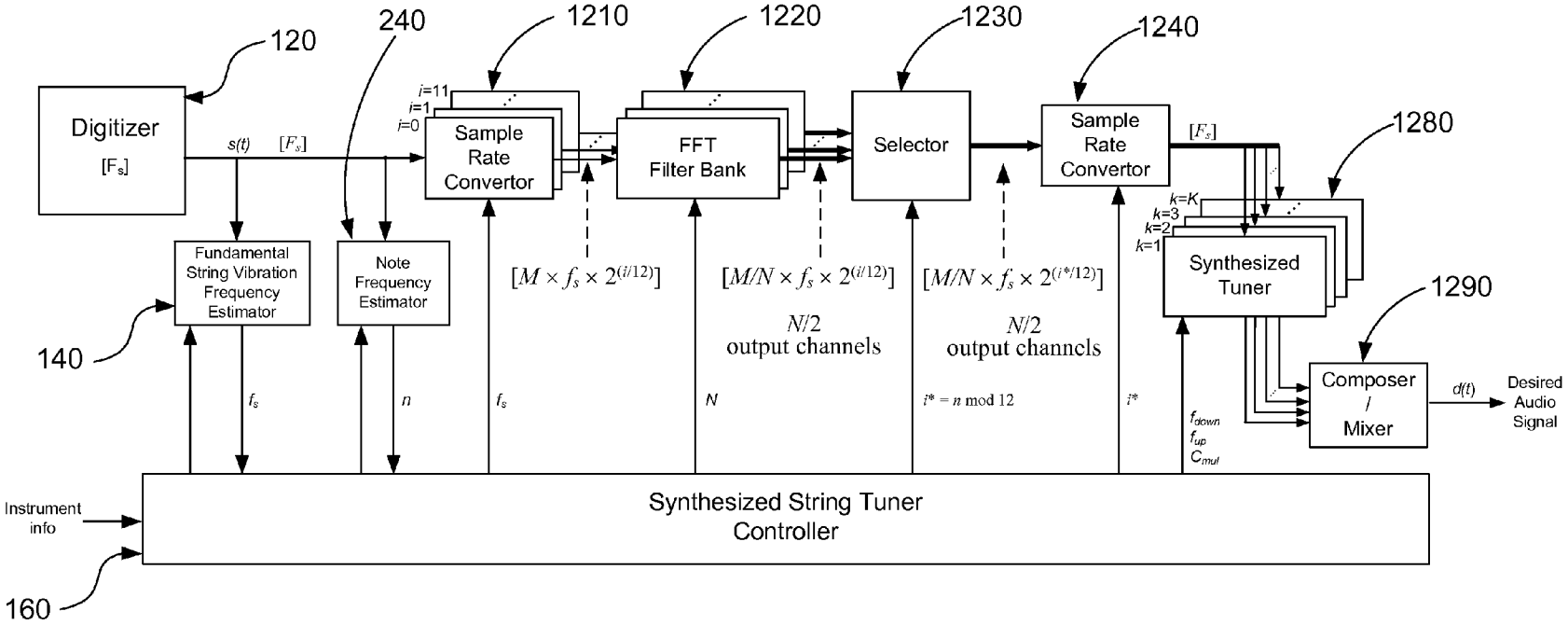
FIG. 13 is a block diagram of system using synchronous FFT component decomposing in accordance with an exemplary embodiment of the invention.

FIG. 13 illustrates a synthesized tuner system using synchronized FFT filter bank implementation. As in previous embodiments, the output of digitizer 120, s(t), is transferred to fundamental frequency estimator 140 and to note frequency estimator 240. Tuner controller 160 controls the musical instrument including all the blocks related to signal tuning. To ensure that the signal components will be located approximately in the canter of the filters of the FFT filter banks, a bank of twelve rate convertors 1210 is used. The rate convertors 1210 converts the sample rate from the digitizer sample rate, Fs, to an integer multiply, M, of the string fundamental frequencies, $f_s$. To cope with the instantaneous shift in frequency of the string incurred by the playing, twelve rate convertors 1210 are used, each convert the sampling rate to a different frequency according to the note shifts within one octave. The sampling rates on the outputs of the twelve rate converters 1210 are $M/N \times f_s \times 2^{(i/12)}$ where i=0, 1, . . . , 11. Each rate converted signal is forward to an FFT in FFT bank 1220. Twelve such TTF filter banks exist in FFT bank 1220, one for each sampling rate. The integer coefficient M determined the number of harmonics that will be able to be processed by the system and it is determined according to the tradeoffs between processing demands and signal quality requirements. In any case, the digitizer 120 sampling rate provide a soft upper limit on M since there is no advantage to have intermediate sampling rate higher then the digitizer sampling rate. If the converted sampling rate is lower then the digitizer sampling rate, a low pass filter is used before or during rate conversion to prevent aliasing of unprocessed harmonics.

Synthesized string tuner controller 160 is continuously monitor note frequency estimator 240. In any stage that the note played on the string is changed, controller 160 commands selector 1230 to select the note matched filter bank output from the twelve filter banks 1220. The command is provided with an appropriate delay to compensate the delays in the note frequency estimator 240, the sample rate convertors 1210 and the FFT filter bank 1220. The selected FFT filter bank 1220 is the one that the fundamental frequency and the harmonics are located approximately near the center of the filter pass-band. If the note played is higher then one octave from the open string fundamental frequency, the played fundamental frequency and the harmonics will reside on multiple of the frequency of the lower octave note so tuner controller 160 command the selector to select the FFT filter bank using the modulo 12 of the note index.

The selected FFT filter bank contain N output channels each with sampling rate of $M/N \cdot f_s \cdot 2^{(i^*/12)}$ where N is the FFT size and i* is the selected rate conversion index. To continue with synthesized tuning processing, the signals first converted back to the output sampling rate. In the current embodiment, the output sampling rate is set to be the same as the input sampling rate. Alternatively, output sampling rate is different then input sampling rate. Sample rate convertor 1240 converts the selected filter bank signals to the output sample rate and forward the component signals to synthesized tuners 1280.

Synthesized tuner 1280 is using one of the techniques revealed in the embodiments illustrated in the application. Output signals of rate convertors 1220 and 1240 are both in base-band format. The synthesized tuner 1280 output signal is generated based on the information provided by tuner controller 160. This information may include $f_{down}$, the center frequency of the down conversion, $f_{up}$, the center frequency of the up conversion, i.e., the desired frequency and $C_{mul}$, the coefficient related to the ratio between the string fundamental frequency and the desired signal fundamental frequency.

The output of all synthesized tuner 1280 are composed, i.e., combined or mixed together, by composer/mixer 1290. This is a straight forward processing of adding all signals together to form the desired signal d(t).

The order of operations in this exemplary illustration may be changed. For example, a selection may be done before the FFT filter bank or after the second rate conversion, the second sample rate conversion may be done before or after the synthesized tuners, etc.

As mentioned above, a different way to overcome the FFT filter bank limitations is using a better filter bank that will avoid the need for synchronization stage. Using filter bank with better performance will overcome the problem raised by the existence of signal components near the cut-off frequencies of the filters in the filter bank.

Assuming that we still have equal spacing filter bank, to cope with the phase signal near the cut-off frequency of each filter in the filter bank, output sample rate of at least twice the sampling rate of simple FFT filter bank, i.e., at least 2·Fs/N, is needed. To reduce the aliasing and the effect of adjacent channels various type of filter banks may be used. An exemplary of implementation using WOLA based filter bank is illustrated.

Figure 14:
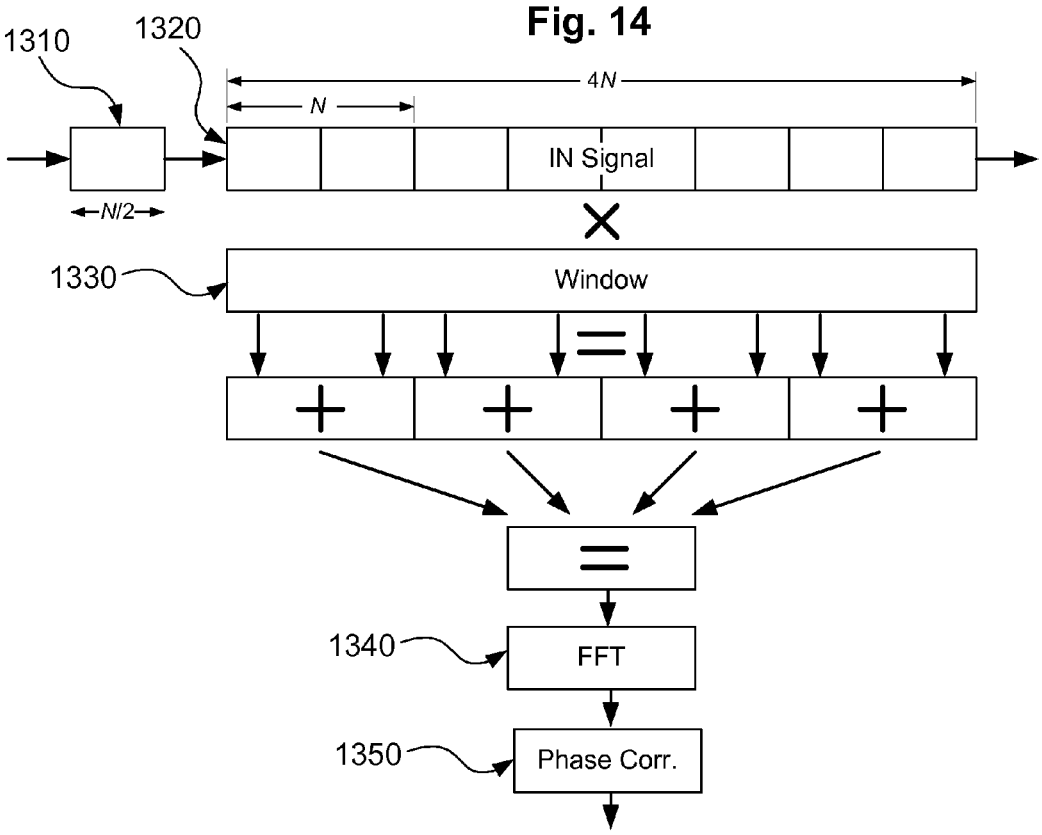
FIG. 14 is a flow diagram of implementing WOLA based filter bank for component decomposing in accordance with an exemplary embodiment of the invention.

Reference is now made to FIG. 14. FIG. 14 illustrates factor four window-overlap-and-add (WOLA) filter bank architecture. The signal input samples are packed into N/2 samples frames 1310. Each time eight input frames 1310 are collected and stored to create a current processing buffer 1320. Buffer 1320 is multiplied element wise with a constant window 1330 with length 4N samples. The result is spited in to four N samples blocks that overlap and add to produce N samples input to an FFT 1340. The FFT output is phase corrected to compensate the time shifts by phase correction unit 1350. The output of phase correction 1350 is N channels filter bank. Channel 0 is the DC which is never used and channels N/2 to N−1 are redundant replication of the N/2 first channels in the case of real input signal. The filter bank output sampling rate depends on the size of frame 1310. In this exemplary illustration, the size is taken to be N/2 samples and accordingly the output sampling rate is 2·Fs/N which is the minimum needed rate to resolve phase signal ambiguity in the range of the pass-band of the filters which is Fs/N. Alternatively, other frame 1310 size and processing buffer size may be used.

Figure 15:
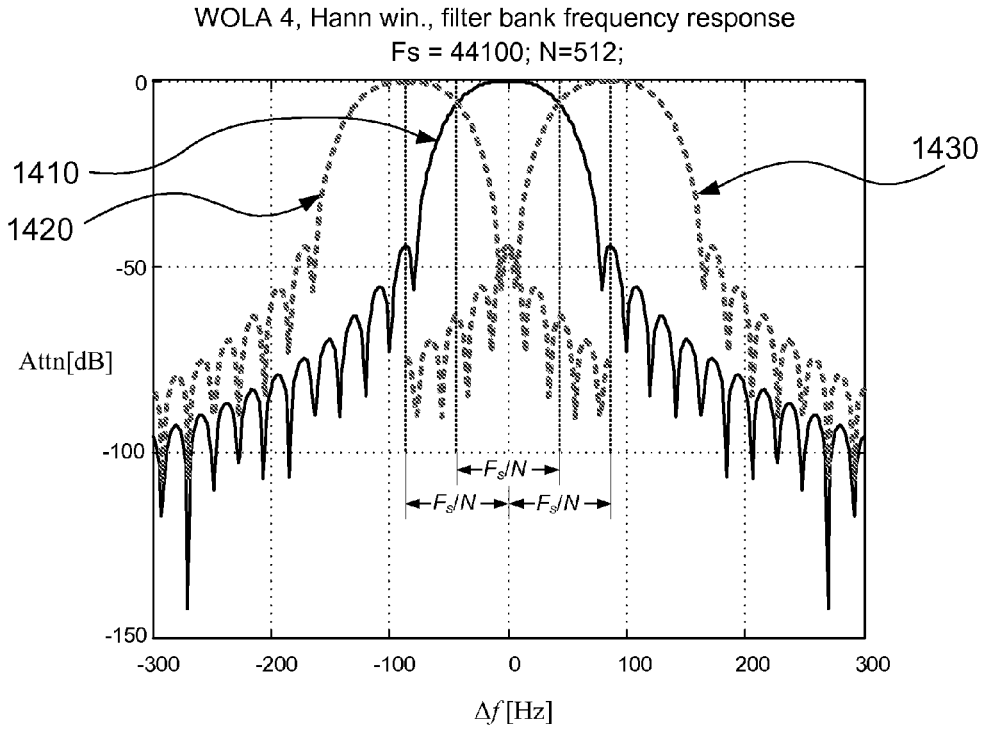
FIG. 15 is a frequency response graph of the exemplary filter bank illustrated in FIG. 14.

Reference is now made to FIG. 15. FIG. 15 illustrates the frequency response of the filter bank illustrated in FIG. 14. The sampling rate is 44,100 Hz, the FFT size, N, is 512 and Hann window is used. The solid line response 1410 represent the frequency response of one filter in the filter bank and the dashed lines 1420 and 1430 represent the frequency response of the adjacent channels. The x-axis is the offset frequencies in Hz and the y-axis is the amplitude of the output of the filter in dB. As can be seen in the figure, the pass-band bandwidth is indeed Fs/N and in the cut-off frequency the response of the filter is equal to the response of the adjacent filter. The response of signal components that are not resides in an adjacent channels are attenuated by over 70 dB hence can be neglected.

The advantage of using this filter bank implementation or similar implementation is that it is not necessary to estimate the instantaneous played note a system. The system that implements such architecture is presented in the following figure.

Figure 16:
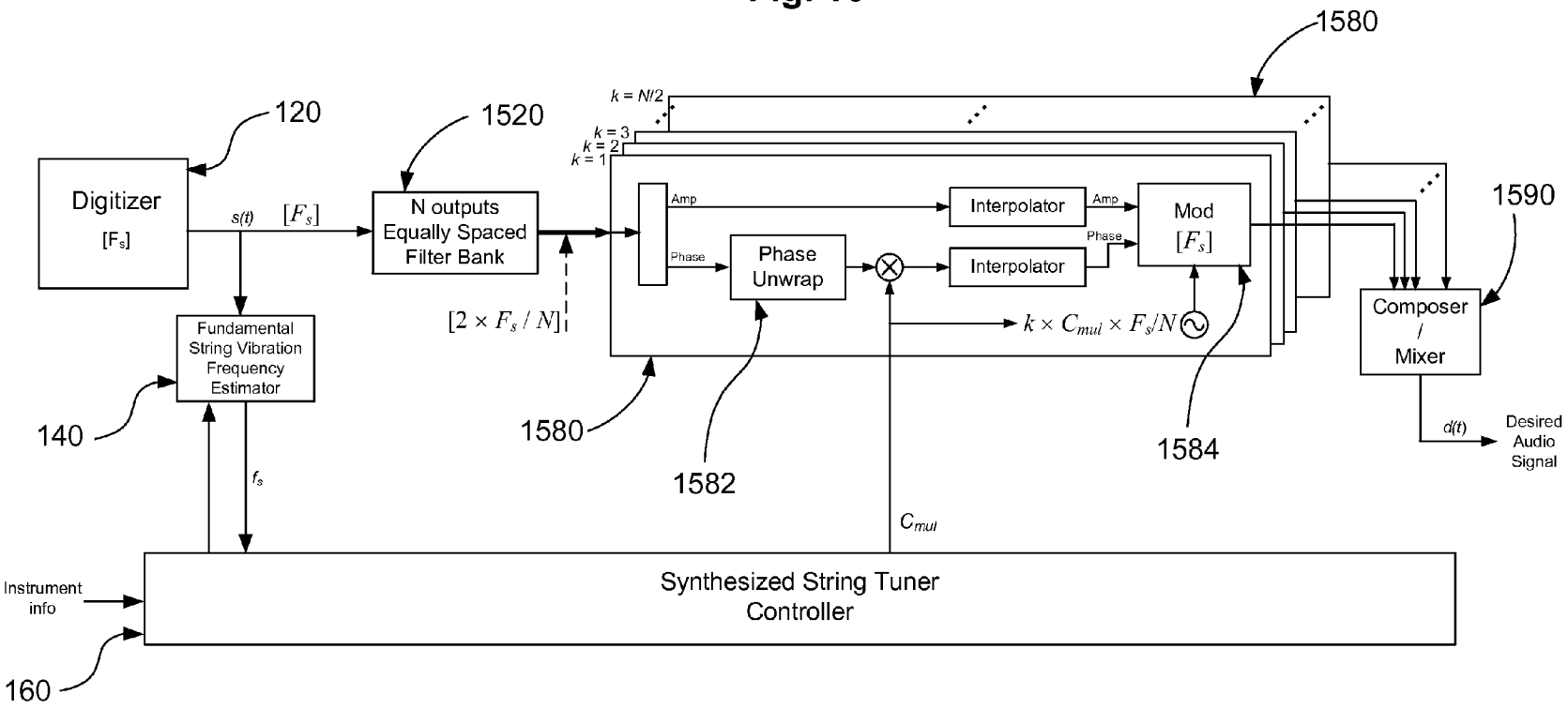
FIG. 16 is a block diagram of system with filter bank component decomposing in accordance with an exemplary embodiment of the invention.

Reference is made now to FIG. 16. FIG. 16 illustrates a synthesised tuner system with equally spaced filter bank that have Fs/N channel spacing, high adjacent channel rejection and sample rate of at least 2Fs/N. The input signal s(t) has sampling rate of Fs and is transferred to a filter bank 1520. Filter bank 1520 is identical or similar to the filter bank illustrated in FIG. 14. The filters output sampling rate is 2Fs/N. Alternatively, the filters output sampling rate is greater then 2Fs/N. N is selected so that the lowest frequency of the vibrating element is higher then Fs/N.

Next to filter bank 1520 there are N/2−1 synthesized tuners 1580. The connections between the filters output and the tuner are as follows: DC filter in filter bank 1580 is not connected to synthesized tuner. Filters with center frequency k·Fs/N wherein k=1, 2, . . . , N/2−1 are connected each to a synthesized tuner 1580. The rest of the filters, those that are associated with center frequencies equal or greater the Nyquist frequency, are not connected to any synthesized tuner 1580. Each synthesized tuner contains phase unwrap unit 1582 that unwrap the phase to get a linear phase signal. This signal is multiplied by the tuning factor, $C_{mul}$, that provided by tuner controller 160. The tuning factor, $C_{mul}$, is calculated by the ratio between the desired string fundamental frequency $f_d$ and the estimated fundamental frequency $f_s$. $f_s$ is provided by fundamental frequency estimator 140.

The unwrapped phase signal and the amplitude signal are interpolated to match the output sample rate, Fs. The interpolation factor depends on the sampling rate of the outputs of the filter bank. In the case of this exemplary embodiment, it is N/2. Finally an AM/PM modulator 1584 is used to create the tuned signal corresponding to each single filter output component of filter bank 1520. The carrier frequency of modulator 1584 is set in accordance with the filter center frequency it is related to. Filters center frequencies of filter bank 1520 are $k \times F_s/N$ wherein k is the index of the filter. The matching carrier frequency of modulator 1584 is set to $k \times C_{mul} \times F_s/N$ to shift the center frequency to the desired signal frequency. Modulator 1584 has AM (amplitude modulation) input and PM (Phase modulation) input. If a specific channel do not have significant component the AM signal will be very low so it will practically disable the contribution of this channel to the output signal. The PM input signal shift the output frequency of the component in accordance with the frequency offset presented in the filter input multiplied by the tuning factor.

The output of all synthesized tuner 1580 are mixed together by composer/mixer 1590 to create the desired tuned signal d(t).

In order for the desired signal d(t) to sound good two phases relationships between components need to be considered. First is the phase between signals generated from different synthesized tuner that are related to different components, e.g., signal form the first harmonics and the second harmonics. While such a phase relationship may be monitored and kept in sync by adjusting a constant initial phase in each modulator 1584, since the ears are not sensitive to such phase difference, it is, in general, not necessary to perform any phase adjustment.

Figure 17:
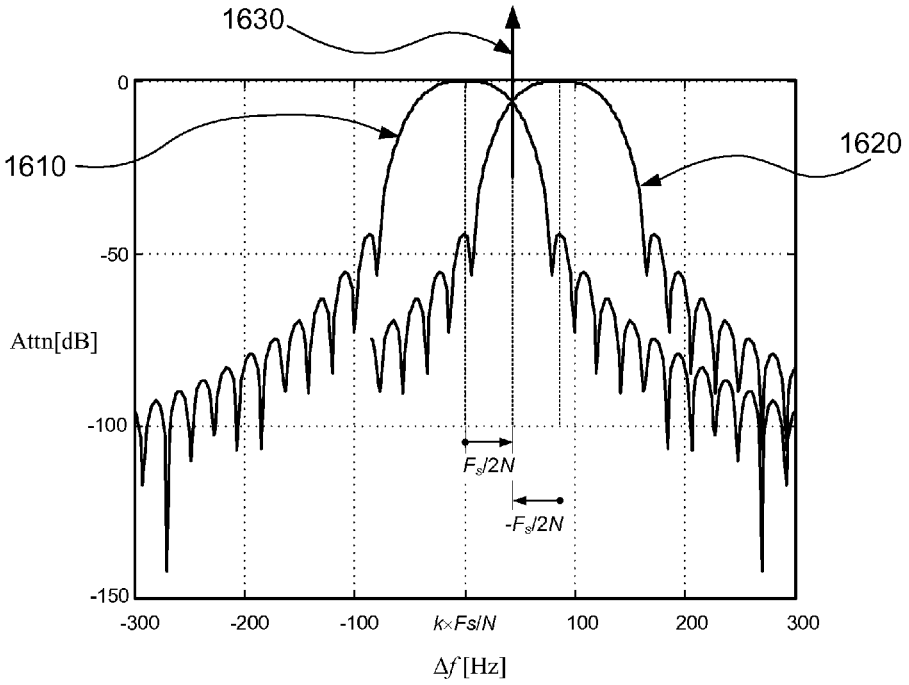
FIG. 17 is a spectral view demonstrating a situation where the signal component falls in between filters in the filter bank.

The second phase relationship is the phase between adjacent synthesized tuners 1580 that are generating together a single component. Typically such a case occurs when the input component is closer to the cut-off frequency of a filter in the filter bank. In the extreme case where the input component frequency is exactly equal to the cut-off frequency the component is received with equal amplitude in two adjacent filters. FIG. 17 illustrate this situation.

Reference is made now to FIG. 17. Two adjacent filter frequency responses are shown in the figure. Frequency response of filter k is illustrated by graph 1610 and frequency response of filter k+1 is illustrated by graph 1620. The input signal component is in frequency (k+½)·Fs/N. The component is intercepted by both filters with the same amplitude, which is 6 dB down from the maximum amplitude of the pass-band of each filter. In filter 1610 the offset frequency is Fs/2N and in filter 1620 the offset frequency is −Fs/2N. It can be easily seen that the output frequency of the synthesized tuner for each channel will have the same frequency. Synthesizer tuner k will have carrier frequency of $C_{mul} \cdot k \cdot Fs/N$ and phase modulation will add $C_{mul} \cdot (½) \cdot Fs/N$ produce overall frequency of $C_{mul} \cdot (k+½) \cdot Fs/N$. Synthesizer tuner k+1 will have carrier frequency of $C_{mul} \cdot (k+1) \cdot Fs/N$ and phase modulation will add, i.e., subtract, $C_{mul} \cdot (-½) \cdot Fs/N$ produce overall same frequency of $C_{mul} \cdot (k+½) \cdot Fs/N$.

If the initial or instantaneous phase difference is equal zero the two signals will add coherently and will produce a correct output signal with the correct amplitude which is exactly the sum of the two filters signal. However, if the initial phase are not zero the output signals might cancel themselves. The phase difference may come from initial phase difference between the filters or by erroneous (noise driven) phase slips in the unwrap units 1582.

Overcoming this problem in signal reconstruction has two stages: (1) recognition of the situation and (2) proper signal reconstruction. There are several ways both to recognize and to signal reconstruction. First let's deal with recognizing a situation that the same component is significantly intercepted by two adjacent filters. One way to recognize is to estimate the fundamental frequency component and the harmonics and to calculate the offset of each component from the center of the filters in the filter bank. If the absolute value of the frequency offset is greater then a threshold, e.g., Fs/4N, then the two adjacent filters are processed together as will be shown next.

Another way to recognize this situation is by locally monitors the outputs of any pair of two adjacent filters. As illustrated in FIG. 17 if two adjacent filters are processing the same component the frequency of the component will be Δf higher then the center frequency in the lower filter and Fs/N−Δf lower in the center frequency in the adjacent higher filter. This can be easily detected by comparing the instantaneous frequencies of each two adjacent filters and if they are close enough and have both significant amplitude, the two adjacent filters are receiving the same signal component and will processed together as will be shown next.

Figure 18:
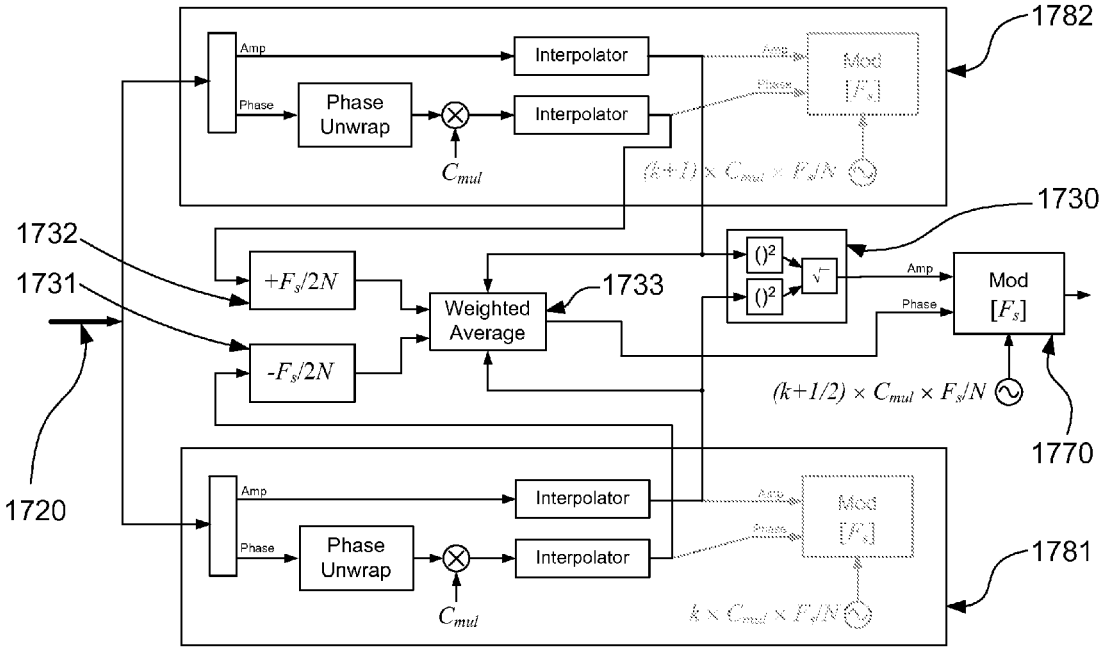
FIG. 18 is a block diagram of combining adjacent channel implementation used to mitigate situations demonstrated in FIG. 17.

Now let's deal with the processing of the signal in this case. One way is to combine the two adjacent filter outputs into a single modulator. The modulator is fed by outputs of both filters by a combined amplitude and phase signals. FIG. 18 illustrate this signal processing.

Reference is made now to FIG. 18. FIG. 18 illustrates combining the signals of adjacent synthesized tuners that process the same signal component. Synthesized tuner 1781 is similar to the k synthesized tuner in the embodiment illustrated in FIG. 16 but its modulator is disabled (illustrated in shade grey in the figure). Synthesized tuner 1782 is similar to the k+1 synthesized tuner in the embodiment illustrated in FIG. 16 and its modulator is also disabled (illustrated in shade grey in the figure). The inputs 1720 of synthesized tuners 1781 and 1782 are the output of filter bank 1520 illustrated in FIG. 16. The interpolated amplitude signal of both synthesized tuners 1781 and 1782 feed the amplitude combiner 1730. Amplitude combiner 1730 takes the root mean square of both amplitudes as the combined amplitude. The combined amplitude feed the AM input of modulator 1770. Modulator 1770 is acting as a combined modulator for both channel k and channel k+1 and its output feed mixer 1590 illustrated in FIG. 16 instead of the original outputs of synthesized tuners 1781 and 1782 that are now disabled. The carrier frequency of modulator 1770 is set to the middle frequency, $(k+½) \times C_{mul} \times F_s/N$ This frequency setup is arbitrary. A carrier frequency of one of the synthesized tuner or any other carrier frequency could be set as long as the combined phase signal will be compensate respectively. The combined phase process first adjusts the offset frequency reference of the phase signal from the filter center frequency to the un-tuned combined modulator carrier frequency. In the case of the exemplary embodiment, the k channel phase signal is frequency shifted down by $-F_s/N$, block 1731, and the k+1 channel phase signal is frequency shifted+$F_s/N$, block 1732. In the exemplary input of FIG. 17, this process yields both phase signals having approximately zero frequency. In any case since the phase signals are derived from a single component after the adjustment the phase signals should be identical up to initial phase difference and a non identical noise added to each signal processing. To combine the adjusted signals a weighted average 1733 is used. The weighted average provides a larger weight to the phase signal of the channel with the larger amplitude. The reason for that is that the signal with the larger amplitude as better signal to noise ratio hence is more reliable. Alternatively, simple average is used. Since the signals are similar the combined signal is also similar to both phase signals. The combined phase signal feed the PM input of modulator 1770.

There are many variations that can be used for the same principle. The phase signal may be processed in the first derivative domain and the modulator may be FM modulator instead of PM modulator. Another way to deal with the coherent combining is to keep the two original modulators and to drive the PM inputs in a way that ensure that the phase signals keep a linear phase relationship of (Fs/N)·t or in other words that the signal from both modulator will combine coherently.

While the application demonstrates varies ways to perform the synthesized tuning of the string vibration signal to the desired tuned frequency signal, it is apparent to those skilled in the art that there are many other combinations and architectures and algorithms that may be used to achieve the same goal.

For the sake of clarity and brevity timing consideration was not presented in the above exemplary embodiment, however one need to take care, in some of the embodiments, to the delay of processing in each path and to balance the delays. It is also important that the total delay of the synthesized tuner will be kept low, i.e., less then 20 milli-seconds, so the player will not notice the delay.

Since the string output sound is generated electronically and is played through speakers or headphone and since the string vibrations are creating its own sound it is important to design the instrument in such a way that the string self audio signal will be as weak as possible. Generally speaking, musical instruments with resonance box (sound box) should not be chosen.

FULL MUSICAL INSTRUMENT EXAMPLES

Reference is now made to the following examples, which together with the above descriptions illustrate some embodiments of full musical instruments in accordance with the invention in a non limiting fashion. In the examples it is assumed that there is a synthesized tuner for at least one string, and preferably for all the instrument strings. It is assumed that the synthesized tuners are providing the desired tone regardless of the specific way the synthesized tuner is implemented. The examples emphasize the overall system aspects and features of the instruments equipped with synthesized tuners in accordance with the current invention.

Figure 7:
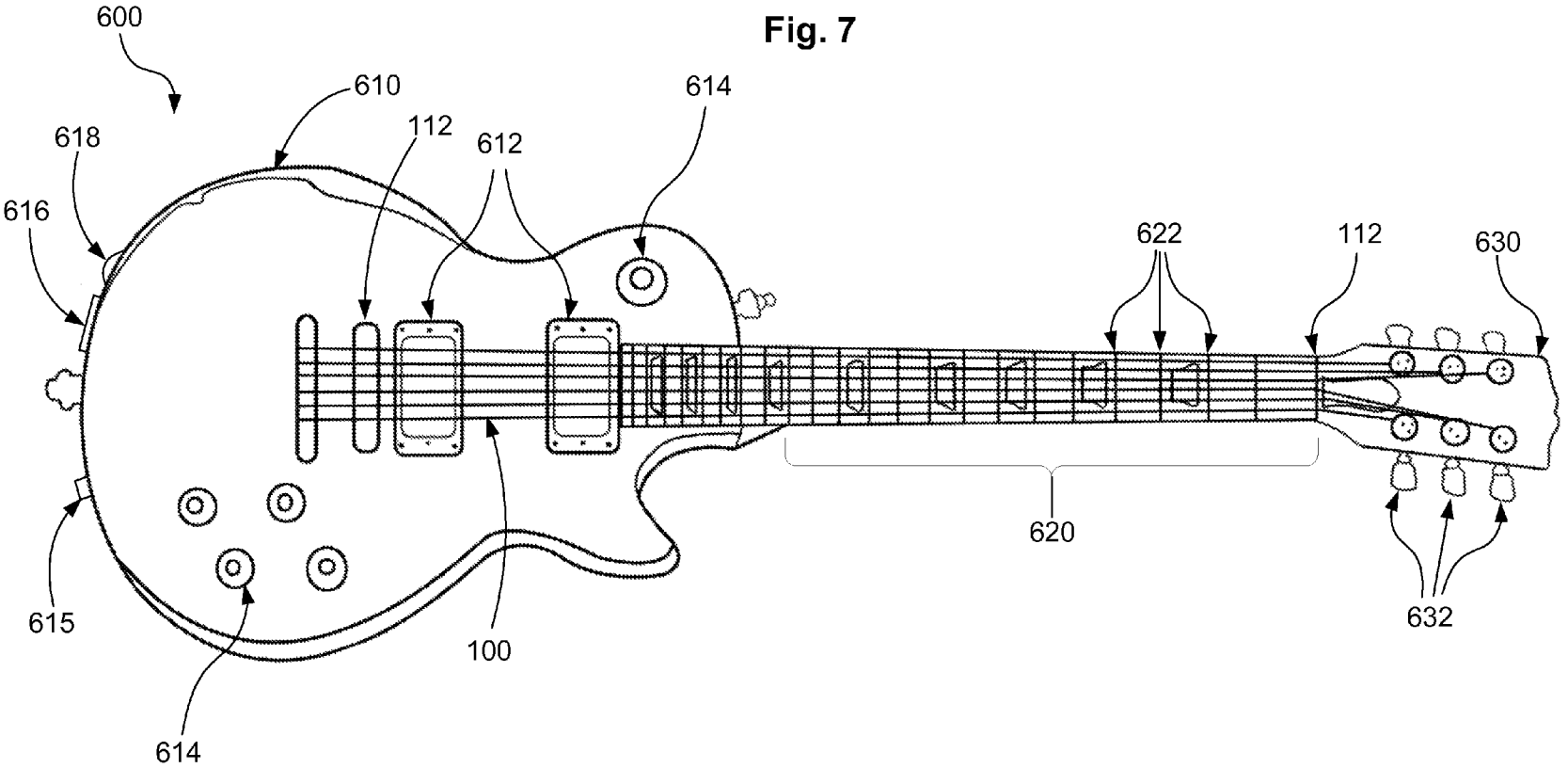
FIG. 7 is an electric guitar retrofit in accordance with an exemplary embodiment of the invention.
Figure 8:
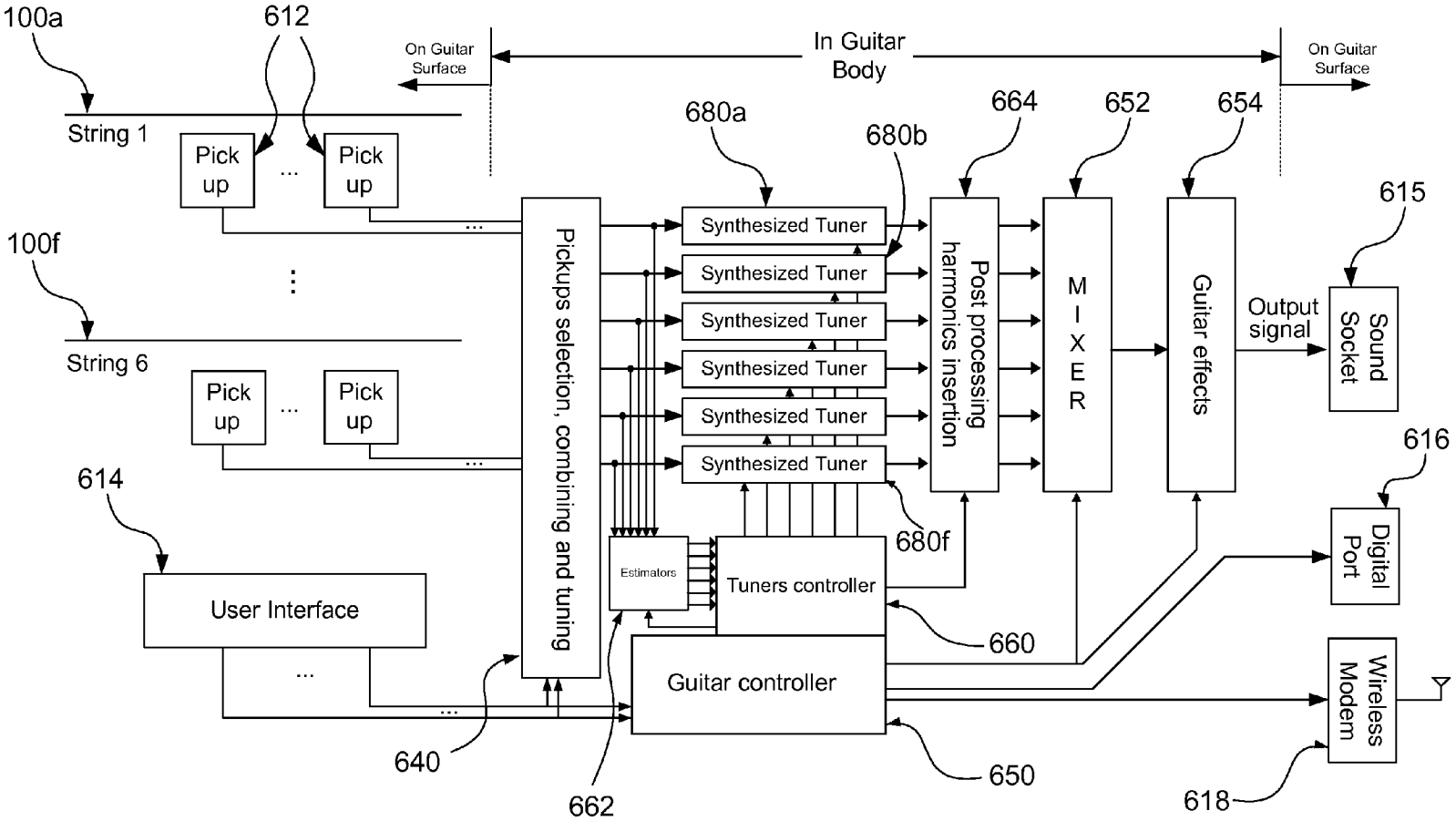
FIG. 8 is a block diagram of the electric guitar retrofit presented in FIG. 7 in accordance with an exemplary embodiment of the invention.

Reference is made now to FIGS. 7 and 8. The embodiment of FIGS. 7 and 8 illustrate a popular Gibson Les Paul electric guitar with retrofit or upgrade according to the current invention. Reference is made now to FIGS. 7. As can be seen in the figure, guitar 600 is a standard electronic guitar comprises body 610, neck 620 and head 630. Guitar 600 has six strings 100 that are held between two string locks 112 one attached to body 610 and the second is between the neck 620 and the head 630. Strings 100 are stretched with tuning pegs 632. To produce the desired tone, the guitar player presses his fingers between frets 622 on the fret board located on the neck 620. String 100 vibrations are picked by pickups 612. Unlike standard Les Paul guitars, pickups 612 are hexaphonic pickup, i.e. each string vibration is picked separately. Typically pickups 612 will be magnetic pickups but the invention is not limited to magnetic pickups and different hexaphonic pickup such as piezoelectric or optical pickup may implement the invention. User interface elements 614 are also available on the guitar surface. FIG. 7 illustrate five user interface elements as in the classic Les Paul guitar. In the original guitar the top switch is used to select: (1) the left pickup; (2) the right pickup or (3) combination of the two pickups. The four knobs on the bottom left are used to set the volume and tone of the two pickups. This exemplary invention keeps backwards compatibility with the original Les Paul guitar user interface so the user interface is kept as similar as possible to the original guitar. The guitar also have back compatible mode so guitar playing without using the invention is also possible according to this exemplary embodiment. The user interface and the operation of the guitar according to this exemplary embodiment will be detailed in a user interface section later. Many variant and different user interface element may be used and the provided one is just a simple exemplary version trying to be similar as possible to the popular Gibson Les Paul guitar.

Pickups 612 are connected to a synthesized string tuner unit as illustrated in FIG. 8. The guitar output sound signal is provided in sound socket 615. In addition, there are two optionally new ports: (1) digital wired port 616 and digital wireless port 618 for advanced features that will be presented later.

Reference is now made to FIG. 8. FIG. 8 illustrates the electronic block diagram of electric guitar 600 in accordance to this exemplary embodiment. The guitars strings 100*a* to 100*f* vibrations are picked by pickups 612. The pickups are hexaphonic so total 6×2=12 pickups are located in the guitar surface (only four are illustrated in FIG. 8, two for the first string, string 100*a*, and two for the sixth string, string 100*f*). Pickups 612 are connected to pickups selection, combining and toning unit 640. In the current example, unit 640 performs the same function as the original Gibson Les Paul guitar. Unit 640 selects or combines the left and right pickups based on the user interface switch and set the volume and tone of each pickup. While in the original Gibson Les Paul guitar this is done on the combined signal from all strings, in the current invention, unit 640 selects or combines the signals from each string pickup separately. Pickups selection, combining and toning unit 640 provides six separate output signals each corresponds to one string, corresponding to string 100*a* to string 100*f* respectively. The outputs of unit 640 are transferred to six synthesized tuners 680*a* to 680*f* respectively. Each unit 640 output is also transferred to estimators unit 662. Estimator unit may include fundamental frequency estimator, note estimator and harmonics estimator as describe in previous embodiments. Estimators unit 662 is controlled by tuners controller 660. Estimators 662 outputs are transferred to tuners controller 660. Tuner controller 660 is part of guitar controller 650. Guitar controller controls all guitar functions, read user interface 614 and control all processing performed by the guitar. Synthesized tuners 680*a* to 680*f* are controlled by tuners controller 660 to tune the strings signals to the required tones according to the user interface setting and the estimators 662 measurements. The outputs of synthesized tuners 680*a* to 680*f* are transferred to post processing unit 664. Post processing unit 664 optionally perform on each string signal harmonic insertion as taught by previous examples or perform other per string signal post processing signal processing as required. The outputs of processing unit 664 are transferred to mixer 652. Mixer 652 combines the six strings signals to one guitar signal. This signal is transferred to guitar effect unit 654. Guitar effect unit 654 adds, optionally, additional digital effects that are performed on the full guitar signals. Those effects can include distortion, filtering, "wha-wha", modulation, "Vibrato", echo, reverb, etc. Guitar effect unit 654 output signal is transferred to the sound socket 615. In an exemplary embodiment of the invention, a standard ¼ inch jack socket is used. Optionally, digital wired port 616 and digital wireless port 618 for advanced features are provided and connected to guitar controller 650. Digital wired port 616 can be USB port, FireWire port or Ethernet port or any other similar port the used to communicate digital information. Digital wireless port 618 can be Wi-Fi, Bluetooth or any other wireless communication protocol.

In an exemplary embodiment of the invention, a rechargeable battery power source is used. This battery can be recharged through digital wire port 616. Additionally or alternatively, power supply is delivered using the sound socket 615.

User Interface and Operation

The standard Les Paul user interface include 5 elements: (1) pickup switch; (2) left pickup volume; (3) left pickup tone; (4) right pickup volume; (5) right pickup tone. The pickup switch in the original guitar contains 3 positions: (1) left pickup used; (2) both pickups used; (3) right pickup used. In the current embodiment a 12 states rotary switch is used for all five elements. The top switch is the guitar mode switch. To provide backward compatibility the current embodiment contains position (2) to (4) in the mode switch as a backward compatibility mode. The full 12 modes are as follows:

(1) off
(2)-(4) backward compatibility mode
(5) remote control mode
(6) tune mode
(7) guitar setup 1
(8) guitar setup 2
(9-11) Pickup selection. Like 2-4 but in synthesized tuner mode
(12) Off Modes (2)-(4), (5) and modes (9)-(11) are the play modes. In play modes the other four UI elements control the pickups in similar fashion as the classic Les Paul guitar. The only change in the UI elements is that instead of continuous knob, twelve 12 state rotary switch are used.

Since, optionally the guitar is powered by rechargeable battery, states (1) and (12), the two edges of the mode selection rotary switch, are off modes that do not consume power. State (5) is remote mode. In remote mode the setup of the guitar is done using a remote host. The remote host can be hand held device or smart phone or a laptop or desktop computer connected via the wired or wireless ports. State (6) is tune mode. In tune mode the player pluck on the strings in open state so the fundamental frequencies of the strings as well as other features can be measured by Estimators 662. State (7) and (8) are (local) setup mode of the guitar. The setup is done using the four bottom left rotary switches. Fore example, one rotary switch can be used to set a capo position. Another can be used for guitar tuning, i.e. the ladder of the tunes of each string. Other switches can be used for setting the strings harmonics, reconfigure the guitar as a bass guitar, setting the post processing effects as well as other setting parameters. The parameters are sampled and stored by pressing on a button located on the top of the mode tottery switch. The user interface in accordance with the invention may be implemented with many various ways and variants.

In modes (9)-(11) the actual output tone of the strings are in accordance to the setup done in states (7) and (8) and in accordance to the tuning performed in state (6). The output sound of the string is determined by the setup and not the actual fundamental vibration frequency of the strings. Actual string fundamental frequency is irrelevant and the player may use standard strings that are not fully tuned. The player may use strings that are completely out of tune. For example, the player can install the same type of string in all six string position and in modes (9)-(11) the guitar will still sound as if a standard set of strings, exactly tuned of course, is used.

Figure 9:
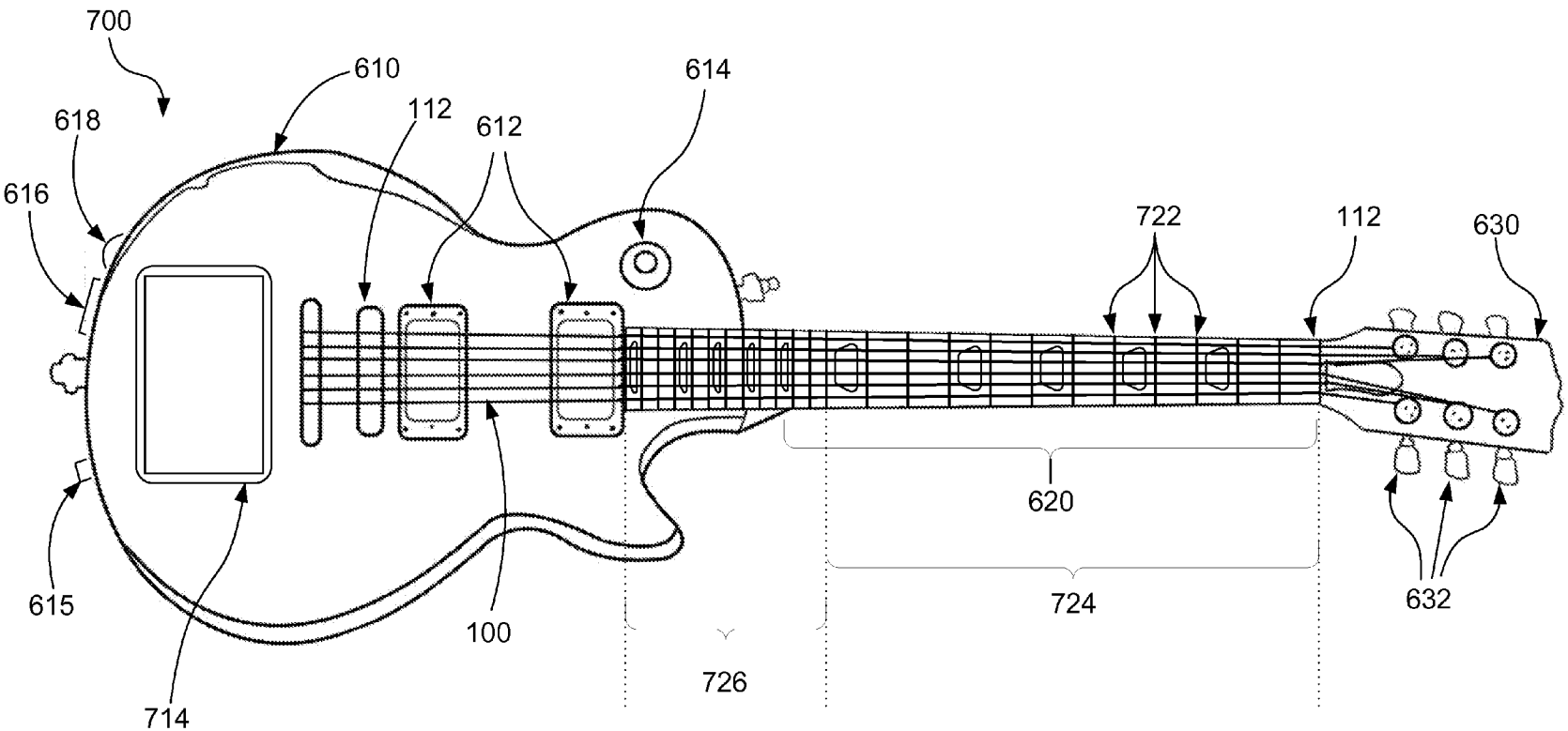
FIG. 9 is another electric guitar in accordance with an exemplary embodiment of the invention.

FIG. 9 illustrates yet another embodiment of electric guitar with more radical changes. Guitar 700 comprises from body 610, neck 620 and head 630 similar to the previous embodiment. Most guitar components are also similar to previous embodiment. Two major changes are provided. The first, frets 722 locations are different then standard guitar frets locations. Frets 722 spacing is different in two regions 724 and 726. In region 724 the frets are spaced equally with 2.5 cm apart from each other. In region 726 the frets are spaced also equally but with 1 cm apart from each other. Each region contains 12 gaps and provides a change in tone of one octave. Note that if such an arrangement is played on strings without the use of synthesized tuners the actual played frequencies will not by half tone apart. Using synthesized string tuners, a half note tune between adjacent fret boxes can be maintained. Furthermore, the range of notes that can be produced by each string in this case is two octaves, which is more then usually achieve in standard electronic guitar. In an exemplary embodiment of the invention, fret spacing is designed with 36 boxes to allow 3 octaves tuning per string. The fret spacing, the length of the neck and strings can be changed arbitrarily to achieve the goal of the guitar designer or player. In the case of this embodiment, region 724 is designed to be used for chord playing and the spacing is comfortable to create chords on the fret board. Region 726 is designed to be used for guitar solo playing and the spacing is comfortable for guitar solo playing. To allow the right compensation in the frequency, the fret spacing is known a priori to the tuner controller. Based on the knowledge of the fundamental frequency of the string and the fret spacing, the string frequency in each fret box is calculated. The desired frequency in each fret box is also known to the tuner controller. Usually it will be according to the western tonal music standard, i.e., the interval between two adjacent notes (or fret boxes) is half tone in a 12-tone scale. Other tonal systems including quarter tones, like in Arabic music and other non 12-tone scale like have been used in the far east can be easily set and played with synthesized tuner as well. For example, change of the fret tonal spacing from half tone to quarter of a tone is just a setup on the user interface, where in a standard guitar such a change is not possible and requires totally different string instrument. The actual finger location on the fret board can be estimated using the instantaneous string vibration frequency. However, knowing directly the fingers location is preferred. In an exemplary embodiment of the invention, Regions 724 and 726 comprise a touch surface that provides the locations of the fingers on the fret board to the tuner controller.

The second change between this embodiment and the previous embodiment is in the user interface. Guitar 700 comprises touch screen 714 located on body 610. Since the variety of setups that can be performed on the current embodiment, the player can set the guitar using touch screen 714. Many styles of user interface can be implemented using touch screen 714 and the variety of setup parameters can be easily set.

In an exemplary embodiment of the invention, the strings 100 of guitar 700 are selected for the comfort of the player or to optimize the performance of the guitar. For example, strings that vibrate at higher frequencies enable shorter delay of digital processing. In an exemplary embodiment of the invention, strings are grouped to plurality of identical strings. In an exemplary embodiment of the invention, all strings are identical. In an exemplary embodiment of the invention, all strings are selected to have nominal frequency of above 200 Hz to accomplish delay less then 20 msec.

Other string instruments can implement according to the invention. In an exemplary embodiment of the invention, an electric violin with synthesized string tuner is implemented. Such an instrument with small form factor device can mimic all bowed string instrument such as viola, cello and contrabass in a single instrument. With just a press on a button a violin can play as a contrabass. Off course, synthesized tuner version of viola, cello or contrabass embodiment can be implemented as well and each embodiment can play the role of the other bowed string instrument as well.

The advantage of having the flexibility to have optimized vibrating element with the ability to delectate control the vibrating element with the full capability of human motor system, like hands and mouth, while not limiting to the physical size of the vibrating elements open the way to variety of string instruments, percussion instruments and wind instrument that from one hand give the flavor of sound of the specific vibrating elements, give the fine control unique to the specific kind of instrument but from the other hand is not restricted to the physical constrains, can be optimized to the human motor system but handle the full spectrum of audio tones.

Figure 10:
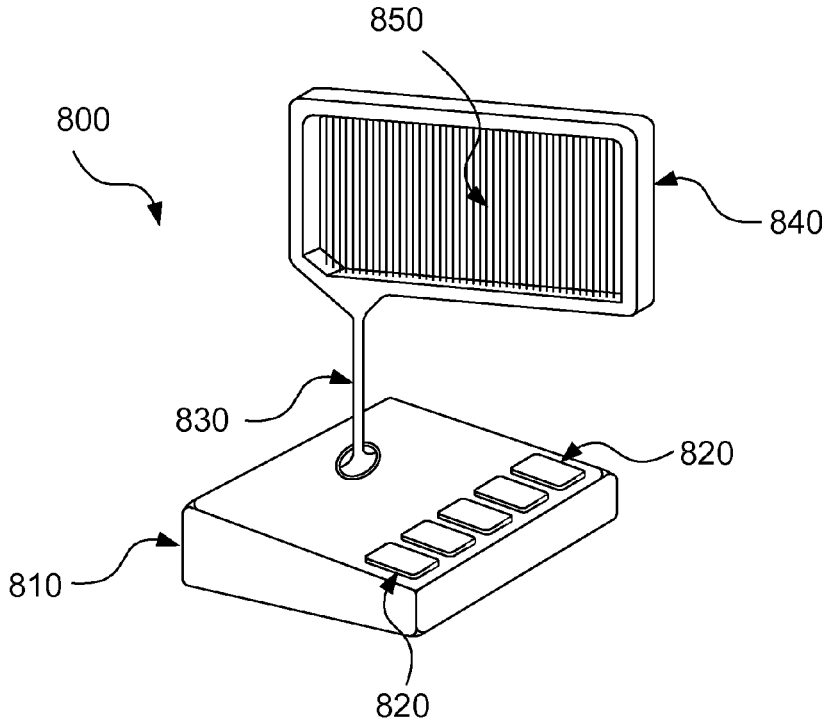
FIG. 10 is an electronic harp in accordance with an exemplary embodiment of the invention.

FIG. 10 illustrate a conceptual synthesized tuner electric harp. Base 810 is standing on the floor. The base comprises pedals 820. Leg 830 is connected to the base 810. Optionally, leg 830 is capable to rotate. Harp body 840 is a frame that comprises strings 850 inside the frame. Since the strings output frequency is determined by synthesized tuners the body shape is not restricted. In the figure rectangular shape is illustrated. Rectangular shape can be implemented since string length no longer plays an important role in the string final tone. Strings 850 are connected to piezoelectric pickups (not shown on the figure) in at least one end of the strings. The pickups are connected to the rest of the electronic system that comprises the synthesized tuners and the tuner controller, located preferably in base 810. Pedals 820 are used to change string tone, e.g. change the octave, or change the sound profile of the string.

There are more then hundred classic and traditional string instruments that have different type and shape many of them can be redesign and exploit synthesized string tuner invention which give a freedom to enhance the instrument and get rid of the limitations imposed by the fundamental connection between the string length, string width and string type and the actual tone of the string. Bowed string instruments or plucked string instruments or struck string instruments may be using synthesized tuners to expand their capabilities.

Figure 11:
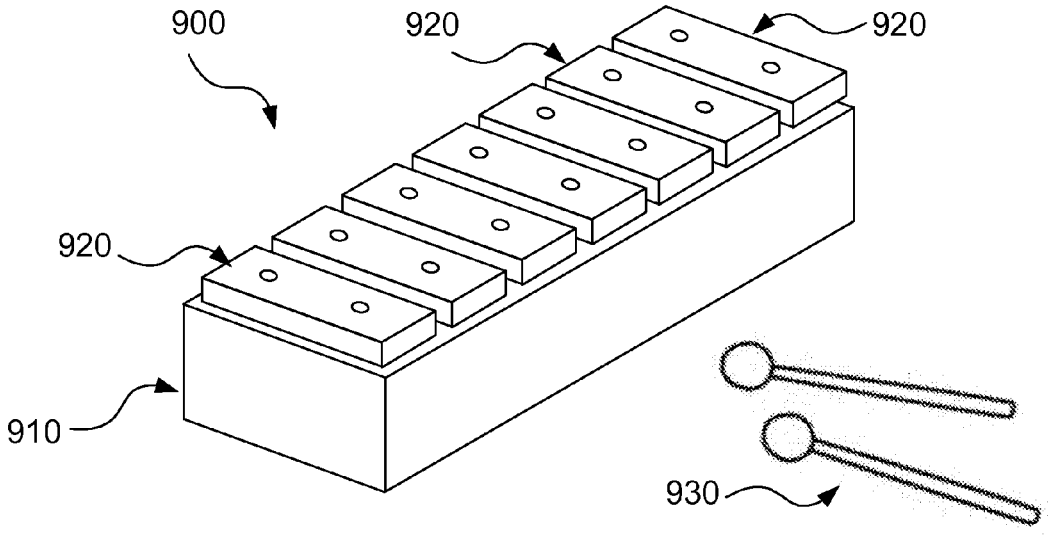
FIG. 11 is an electronic xylophone in accordance with an exemplary embodiment of the invention.

Although string vibration is the most popular way to create music sound, the invention is not limited to strings and other musical instruments such as percussion instruments and wind instrument can implemented using the invention, For example, FIG. 11 illustrate a synthesized tuner version of xylophone. Xylophone 900 comprises from base 910, row of vibrating bars 920 and sticks 930. Bars 920 are raised from the base and connected using two connection points to base 910. When struck using sticks 930, bars 920 vibrate and produce sound. In standard xylophone bars are in different size (length and/or width) so they will produce different vibration frequency. In this exemplary embodiment bars 930 are identical and vibrate in the same frequency. The connection points of the bar comprise piezoelectric pickups that receive bars 920 vibrations. Alternatively, laser based pickup that measure the distance of the bars from base in different locations of bars 930 is used as a pickup. Using synthesized tuner each bar is tuned to different frequency. The user interface for the xylophone setup is located in base 910 (for clarity not shown on the figure). The synthesized tuner, tuner controller and all other electronics, as well as optionally amplification unit and loudspeaker also located inside the base.

In an exemplary embodiment of the invention, a drum set containing in each drum a pickup and a synthesized tuner. The drums size may be equal and small with close enclosure so the sound of the drumming is picked up internally and tuned to different bass frequency. The electric signal of each drum is amplified and sounds on a speakers. One advantage of the drum set is that the drum player can practice with headphones without disrupting the surrounding.

In an exemplary embodiment of the invention, an organ with enclosed box of pipes and air compressor are used. Each pipe contains a pickup and digitizer. The pipes may be identical and very small. The sound of each pipe is tuned by the synthesizer tuner.

In an exemplary embodiment of the invention, an accordion with synthesized tuner is provided. The air pathways control system and reeds are identical and enclosed to reduce the mechanical sound heard outside the enclosure. Each reed has its own pickup, digitizer and synthesized tuner. The accordion sound is sensitive to the controls of both the accordion buttons and the air pressure from pulling and pushing the accordion wings. The electrical signal is amplified and played via a speakerphone build in the accordion and get its power from a battery or a power chord. Alternatively, external amplifier and speakers are used to play the accordion sound.

Other wind instrument such as harmonica may used the same concept. The common to all those synthesized tuner version of the instruments is that they can be played in a much wider range of musical notes can benefit from all digital processing including the exact tuning but can keep the fine control and "color" that their analog instrument counterpart had.

In an exemplary embodiment of the invention, the method of tuning a signal thought above is used for any type of signals. In an exemplary embodiment of the invention, the invention comprises an electronic device having input port, output port synthesized tuner and a way to control the tuning factor and the output signal is tuned according to the embodiments and algorithms thought herein.

It is expected that during the life of a patent maturing from this application many relevant musical instrument will be developed and the scope of the term is intended to include all such new technologies a priori.

The terms "comprises", "comprising", "includes", "including", "having" and their conjugates mean "including but not limited to".

As used herein, the singular form "a", "an" and "the" include plural references unless the context clearly dictates otherwise. For example, the term "a string" or "at least one string" may include a plurality of strings.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A musical instrument comprising:

(a) plurality of identical vibrating elements located in different locations in said musical instrument having approximately the same fundamental vibration frequencies;

(b) a digitizer associated with each said vibrating element;

(c) an estimator that measures the fundamental vibration frequency of said vibrating element; and (d) a synthesized tuner, that conditioned upon at least said estimated fundamental frequency of each vibrating element, generate an audio signal that comprises the characteristics of the original vibration signals with a new different fundamental frequency for each said original vibration signal;

wherein said new fundamental frequencies are determined in a manner conditional upon at least said location of said vibrating element in said musical instrument.

2. The musical instrument of claim 1, wherein said synthesized tuner is used to make a significant change in the range of frequencies produced by said vibrating elements.

3. The musical instrument of claim 1, wherein said musical instrument is a guitar or a violin or a harp or a bowed string instrument or a plucked string instrument or a struck string instrument.

4. The musical instrument of claim 1, wherein said musical instrument is a xylophone or a drum set or a multi element percussion instrument or an organ or an accordion or a harmonica or a multi vibrating element wind instrument.

5. The musical instrument of claim 1, wherein said synthesized tuner comprises frequency down conversion followed by phase multiplication processing that further followed by frequency up conversion.

6. The musical instrument of claim 5, wherein said synthesized tuner comprises harmonics removal before signal tuning and harmonics insertion after the signal tuning.

7. The musical instrument of claim 5, wherein said synthesized tuner comprises decomposing said signal to its components (fundamental and plurality of harmonics), tuning each component separately and compose the tuned components to generate said generated signal.

8. The musical instrument of claim 7, wherein said decomposing is performed using a filter bank.

9. A method for tuning signal of vibrating element comprising:

(a) digitizing the vibration of said vibrating element;

(b) estimating the fundamental frequency of the vibration; and (c) conditioned upon at least said estimated fundamental vibration frequency, generate a signal that comprises the characteristics of the original vibration signal with a different fundamental frequency, wherein said step of generating said signal comprises frequency down conversion followed by phase multiplication processing that further followed by frequency up conversion.

10. The method of claim 9, wherein the coefficient of said phase multiplication is determined by the ratio between the original vibration fundamental frequency and the desired fundamental frequency.

11. The method of claim 9, wherein said step of generating said signal comprises at least one of (a) phase unwrapping; (b) frequency demodulation; c) amplitude demodulation; (d) instantaneous frequency signal multiplication; (e) frequency modulation; (f) amplitude modulation; (g) harmonics removal; (h) harmonics insertion; (i) frequency domain stretch, shrink and shift operations; and (j) time domain stretch, shrink and shift operations.

12. The method of claim 9, wherein said step of generating said signal comprises harmonics removal before signal tuning and harmonics insertion after the signal tuning.

13. The method of claim 9, wherein said step of generating said signal comprises decomposing said signal to its components (fundamental and plurality harmonics), tuning each component separately and compose the tuned components to generate said tuned signal.

14. An electronic device for tuning signals comprising:

(a) port for signal input;

(b) an estimator that measures the fundamental frequency of said signal;

(c) a synthesized tuner, that conditioned upon at least said estimated fundamental frequency, generate an output signal that comprises the characteristics of the original signal with a different new fundamental frequency; and (d) port for outputting the tuned signal, wherein said step of generating said signal comprises frequency down conversion followed by phase multiplication processing that further followed by frequency up conversion.

15. The electronic device of claim 14, wherein the coefficient of said phase multiplication is determined by the ratio between the original vibration fundamental frequency and the desired fundamental frequency.

16. The electronic device of claim 14, wherein said step of generating said signal comprises at least one of (a) phase unwrapping; (b) frequency demodulation; (c) amplitude demodulation; (d) instantaneous frequency signal multiplication; (e) frequency modulation; (f) amplitude modulation; (g) harmonics removal; (h) harmonics insertion; (i) frequency domain stretch, shrink and shift operations; and (j) time domain stretch, shrink and shift operations.

17. The electronic device of claim 14, wherein said step of generating said signal comprises harmonics removal before signal tuning and harmonics insertion after the signal tuning.

18. The electronic device of claim 14, wherein said step of generating said signal comprises decomposing said signal to its components (fundamental and plurality harmonics), tuning each component separately and compose the tuned components to generate said tuned signal.

* * * * *